US011167950B2

(12) United States Patent
Atsumi et al.

(10) Patent No.: US 11,167,950 B2
(45) Date of Patent: Nov. 9, 2021

(54) SHEET FOLDING PROCESSING APPARATUS AND IMAGE FORMING SYSTEM INCLUDING THE SAME

(71) Applicants: Keiichi Atsumi, Yamanashi-ken (JP); Akihito Sakano, Yamanashi-ken (JP)

(72) Inventors: Keiichi Atsumi, Yamanashi-ken (JP); Akihito Sakano, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 16/843,141

(22) Filed: Apr. 8, 2020

(65) Prior Publication Data

US 2020/0324994 A1 Oct. 15, 2020

(30) Foreign Application Priority Data

Apr. 11, 2019 (JP) ..... JP2019-075417

(51) Int. Cl.
*B65H 45/14* (2006.01)
*B65H 45/20* (2006.01)
*B65H 45/04* (2006.01)

(52) U.S. Cl.
CPC ..... *B65H 45/14* (2013.01); *B65H 45/04* (2013.01); *B65H 45/20* (2013.01); *B65H 2801/06* (2013.01)

(58) Field of Classification Search
None
See application file for complete search history.

(56) References Cited

U.S. PATENT DOCUMENTS

| | | | | |
|---|---|---|---|---|
| 8,317,181 | B2 * | 11/2012 | Suzuki | B65H 45/18 270/45 |
| 10,974,922 | B2 * | 4/2021 | Enomoto | B65H 45/30 |
| 2020/0180897 | A1 * | 6/2020 | Shimizu | B65H 45/20 |
| 2020/0180899 | A1 * | 6/2020 | Enomoto | B65H 9/006 |
| 2020/0207569 | A1 * | 7/2020 | Enomoto | B65H 45/30 |
| 2020/0324995 | A1 * | 10/2020 | Takahashi | B65H 45/18 |

FOREIGN PATENT DOCUMENTS

| | | | |
|---|---|---|---|
| JP | 2002-068583 | A | 3/2002 |
| JP | 2009274393 | A * | 11/2009 |
| JP | 2012-171727 | A | 9/2012 |

* cited by examiner

*Primary Examiner* — Leslie A Nicholson, III
(74) *Attorney, Agent, or Firm* — Manabu Kanesaka

(57) ABSTRACT

A sheet folding processing apparatus performs folding processing on continuously conveyed sheets without lowering productivity. A sheet folding processing apparatus includes a conveyance roller pair, a folding roller pair forming a plurality of fold lines by bending a sheet conveyed from the conveyance roller pair in Z-shape, an additional folding roller and a lower folding guide arranged downstream of the folding roller pair to face each other and pressing the fold line of the sheet in corporation with each other, and a controller controlling operation of the above. The controller controls the folding roller pair to convey the sheet with the fold line downstream in a conveyance direction until the fold line passes through the additional folding position by a predetermined conveyance amount, to return the sheet upstream by reversely rotating the folding roller pair, and to position the fold line to the additional folding position for additional folding processing.

13 Claims, 13 Drawing Sheets

SHEET FOLDING PROCESSING APPARATUS AND IMAGE FORMING SYSTEM INCLUDING THE SAME

CROSS-REFERENCE TO RELATED APPLICATION

The present application is based on and claims priority of Japanese Patent Application No. 2019-075417 filed on Apr. 11, 2019, the disclosure of which is incorporated herein.

TECHNICAL FIELD

The present invention relates to a sheet folding processing apparatus which performs folding processing on a sheet, and an image forming system including the sheet folding processing apparatus such as a copier, a printer, a facsimile, and a compound machine of the above.

BACKGROUND ART

Conventionally, a sheet folding processing apparatus (post processing apparatus) which is installed in an image forming system such as a copier and a printer and performs folding processing on an image formed sheet has been widely known. The folding processing includes double folding in which a sheet is folded at a center position, triple folding in which a sheet is folded inward at two positions, and so-called Z folding in which a sheet is alternately folded inward and outward to be folded in three.

For example, Japanese Patent Application Laid-Open No. 2002-68583 discloses a paper piece folding apparatus in which a pair of feed rollers is provided on the upstream side of a horizontal upper guide plate, a pair of paper folding rollers is provided on the downstream side thereof, and a paper piece guiding-deflecting member (i.e., a pushing member) is provided on the upstream side of the pair of paper folding rollers. In this apparatus, the paper piece guiding-deflecting member is moved from a second position retracted obliquely downward on the upstream side of the pair of paper-folding rollers to a first position in which the front end thereof is brought close to a paper piece inlet of the pair of paper folding rollers, and a predetermined position of the paper piece hanging in the space in front of the pair of paper folding rollers is drawn into the paper piece inlet to fold the paper piece into double folding or Z folding.

In the paper piece folding apparatus disclosed in Japanese Patent Application Laid-Open No. 2002-68583, since folding processing is performed on a sheet only by one folding roller pair, when folding effect is small, there is a fear that thickness (folding height) of a fold line formed on the sheet is increased. Therefore, in order to prevent such a problem, there is known a technique in which a fold line is formed by performing folding processing once on a sheet in a folding processing unit, and then the fold line is further pressed by another pressing member (additional folding processing).

For example, Japanese Patent Application Laid-Open No. 2012-171727 discloses an apparatus in which, when folding processing is respectively performed on continuously conveyed sheets (papers), a preceding sheet on which folding processing has been performed is temporarily stacked in a separate conveyance path, the stacked preceding sheet and a subsequent sheet are conveyed to a sheet additional folding portion after folding processing on the subsequent sheet is completed, moving a sheet re-pressurizing roller along a fold line in a direction intersecting a conveyance direction of the sheets on the fold line of the sheets in a state that the preceding sheet and the subsequent sheet are overlapped, and the folded portion (fold line) of the both are re-pressurized.

SUMMARY OF THE INVENTION

In the sheet folding apparatus disclosed in Japanese Patent Application Laid-Open No. 2012-171727, the re-pressurizing roller is moved from one end to another end of the sheet along the fold line of the sheet at the time of the additional folding processing, and therefore there is a problem that the additional folding processing takes a long time. Further, since it is necessary to provide a conveyance path and a space for stacking the preceding sheet, there arises a problem that the apparatus is increased in size and cost.

The present invention has been made to solve the problems existing in the above-described related art. The object thereof is to provide a sheet folding processing apparatus capable of accurately performing additional folding processing on continuously conveyed sheets without lowering productivity while suppressing an increase in size and cost of the apparatus.

In view of the above-described object, a sheet folding processing apparatus of the present invention includes a feeding roller which conveys a sheet in a conveyance direction, a folding roller pair which is arranged downstream in the conveyance direction of the feeding roller, rotates while nipping a predetermined position of the sheet conveyed by the feeding roller, and forms a fold line at the predetermined position, a pushing member which is capable of moving the sheet to a pushing position at which the predetermined position is nipped by the folding roller pair by pushing the sheet, a first pressing member which is arranged downstream in the conveyance direction of the folding roller pair and presses the fold line, a second pressing member which is arranged facing the first pressing member to nip the conveyed sheet and presses the fold line in corporation with the first pressing member, a moving mechanism which moves the first pressing member between a pressing position at which the first pressing member is brought close to the second pressing member and at which the fold line positioned at an additional folding position between the first pressing member and the second pressing member in the conveyance direction is pressed, and a retracting position at which the first pressing member is separated from the second pressing member in a direction being separated from the sheet, the moving mechanism further moving the first pressing member along the fold line with respect to the second pressing member in a state that the first pressing member is moved to the pressing position, and a controller which controls the feeding roller, the folding roller pair, the pushing member, the first pressing member, and the moving mechanism, wherein the controller controls the folding roller pair and the moving mechanism to form the fold line by the folding roller pair, convey the sheet downstream in the conveyance direction until the fold line passes through the additional folding position by a predetermined conveyance amount, convey the sheet upstream in the conveyance direction by reversely rotating after once stopping, stop sheet conveyance at a position where the fold line returns to the additional folding position, and then perform the additional folding processing by pressing the fold line between the first pressing member and the second pressing member.

Further, the present invention provides an image forming system including an image forming apparatus which forms an image on a sheet and discharges the image-formed sheet, and the sheet folding processing apparatus which performs folding processing on the sheet discharged from the image forming apparatus.

According to the present invention, it is possible to adjust a position of a rear end of a sheet, that is, an upstream end in the conveyance direction when additional folding processing is performed on a fold line of the sheet by appropriately setting a predetermined conveyance amount by which the fold line of the sheet passes through the additional folding position until a folding roller pair is temporarily stopped and reversely rotated. Thus, it is possible to prepare for efficiently conveying a sheet to be subsequently subjected to folding processing into the sheet folding processing apparatus. Therefore, for example, in the image forming apparatus on the upstream side that supplies a sheet to the sheet folding processing apparatus, a fear of unnecessarily delaying image forming processing on a sheet is eliminated, and it is possible to avoid lowering productivity of the entire system including the folding processing.

EMBODIMENTS OF THE INVENTION

In the following, preferred embodiments of the present invention will be described with reference to the attached drawings.

First, an overall configuration of an image forming system including a sheet folding processing apparatus according to the present invention will be described with reference to FIG. 1. The image forming system is configured to include an image forming apparatus A, a sheet folding processing apparatus B, and a post processing apparatus C. After performing folding processing at the sheet folding processing apparatus B on a sheet S on which an image has been formed at the image forming apparatus A, the sheet S is subjected to stapling processing, alignment processing, and the like at the post processing apparatus C on the downstream side as necessary, and is discharged to a storage tray 27 on the downstream side. The image forming system may have various mechanisms such as a copier, a printer, and a printing machine. In the following, the image forming apparatus A, the sheet folding processing apparatus B, and the post processing apparatus C will be described in detail.

[Image Forming Apparatus]

Figure 1:
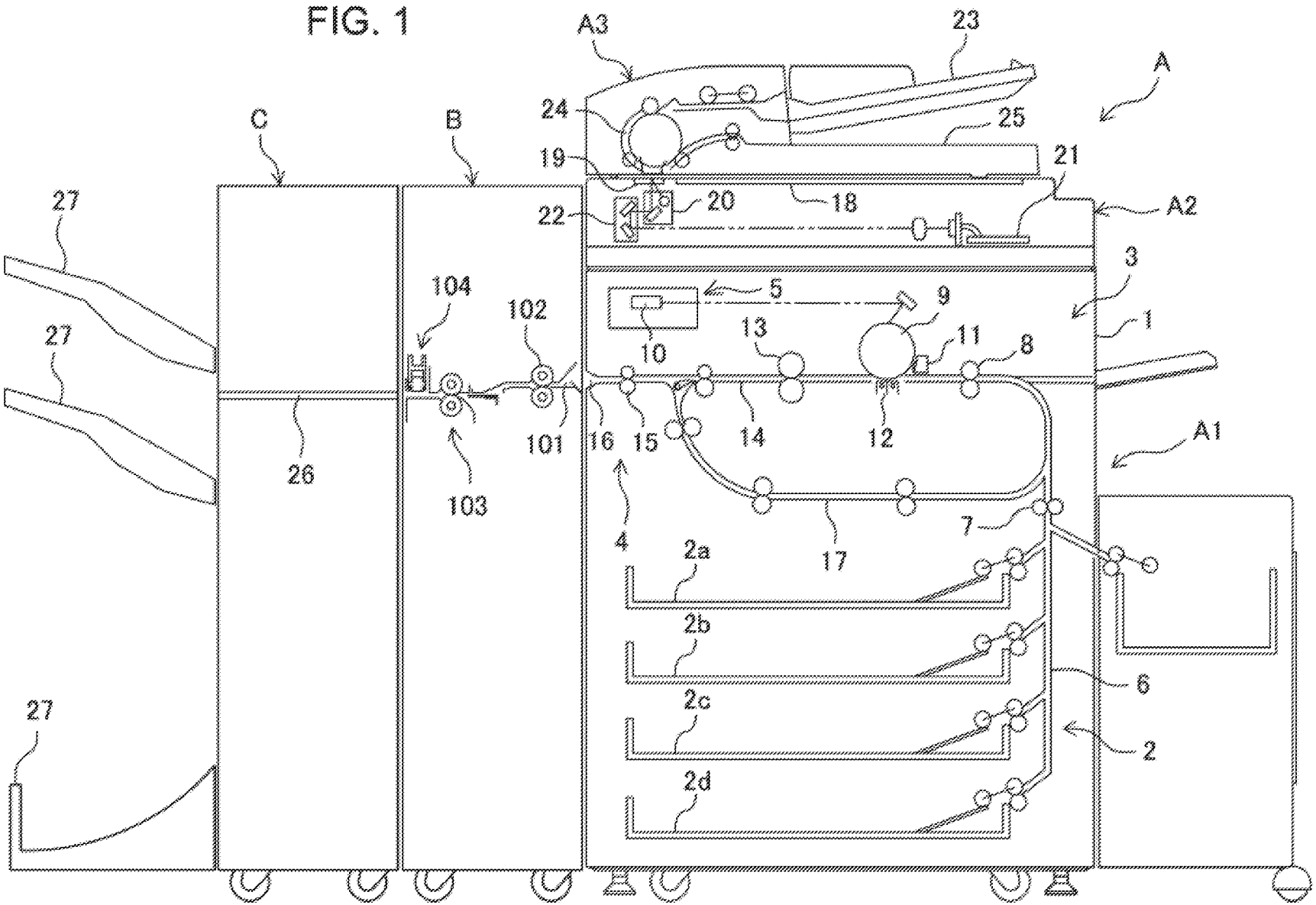
FIG. 1 is an overall configuration diagram of an image forming system including a sheet folding processing apparatus according to the present invention.

As illustrated in FIG. 1, the image forming apparatus A includes an image forming unit A1, a document reading unit A2, and a document feeding unit A3. The image forming unit A1 includes a sheet feeding section 2, an image forming section 3, a sheet discharging section 4, and a data processing section 5 in an apparatus housing 1.

The sheet feeding section 2 includes a plurality of cassettes 2*a*, 2*b*, 2*c*, and 2*d*, and each of the cassettes 2*a*, 2*b*, 2*c*, and 2*d* can store sheets S of different standard sizes selected in advance. Each of the cassettes 2*a*, 2*b*, 2*c*, and 2*d* includes a separation mechanism for separating sheets S therein one by one and a sheet feeding mechanism for feeding the sheet S. Sheets S stored in the sheet feeding section 2 having such a configuration are fed to the sheet feeding path 6 in a size designated by a main body controller (not illustrated) of the image forming apparatus A. The sheet feeding path 6 is provided with a conveyance roller 7 disposed at an intermediate part thereof for conveying sheets S fed from the plurality of cassettes 2*a*, 2*b*, 2*c*, and 2*d* to the downstream side, and a registration roller 8 disposed at an end part of the sheet feeding path 6 for aligning the front end of the sheets S. The sheets S having the front end aligned by the registration roller 8 are fed to the image forming section 3 on the downstream side at a predetermined timing.

The image forming section 3 may be configured to form an image on the sheet S fed from the sheet feeding section 2, and various image forming mechanisms can be adopted. In the illustrated embodiment, an electrostatic image forming mechanism is shown as the image forming section 3. However, the image forming section 3 is not limited to the illustrated electrostatic image forming mechanism, and an ink jet image forming mechanism, an offset image forming mechanism, or the like may be adopted as well.

In the image forming section 3 illustrated in FIG. 1, a photoreceptor 9 (a drum and a belt) and a light emitter 10 for emitting an optical beam to the photoreceptor 9 are provided, and a developing device 11 (developer) and a cleaner (not illustrated) are disposed around the photoreceptor 9 which rotates. A monochrome printing mechanism is shown, in which a latent image is optically formed on the photoreceptor 9 by the light emitter 10, and toner ink is adhered to the latent image by the developing device 11. The ink image (ink toner) adhered to the photoreceptor 9 is image-transferred by a transfer charger 12 onto the sheet S fed from the sheet feeding section 2, fixing is performed on the image-transferred sheet S by a fixing roller 13, and then, the sheet S is fed to the sheet discharging path 14. Further, a circulation path 17 is provided in the image forming section 3. After the sheet S from the sheet discharging path 14 is turned upside down in a switchback path, the sheet S is fed to the registration roller 8 again, an image is formed on a back surface of the sheet S, and the sheet S is sent to the sheet discharging path 14. In the sheet discharging path 14, a sheet discharging roller 15 is disposed and a sheet discharging port 16 is formed at the end thereof. The sheet S is conveyed from the sheet discharging port 16 to the sheet folding processing apparatus B by the sheet discharging roller 15.

The document reading unit A2 that optically reads a document image formed at the image forming section 3 is provided above the image forming unit A1 configured as described above, and a document feeding unit A3 is mounted above the document reading unit A2.

The document reading unit A2 includes a first platen 18 and a second platen 19 formed of transparent glass, a reading carriage 20, a light source mounted on the reading carriage 20, a photoelectric conversion element 21, and a reduction optical system 22 configured by combining a mirror and a lens. The reading carriage 20 scans along the first platen 18 so that light from the light source is illuminated on an image of the document sheet S placed on the first platen 18, reflected light from the image of the document sheet S is guided to the photoelectric conversion element 21 at the reduction optical system 22, and thus the image is read. The photoelectric conversion element 21 converts image data into an electric signal and transfers the electric signal to the image forming section 3.

The document feeding unit A3 includes a sheet feeding tray 23, a sheet feeding path 24, and a sheet discharging tray 25, and conveys documents placed on the sheet feeding tray 23 one by one along the sheet feeding path 24, passes the sheet over the second platen 19, and discharges the sheet to the sheet discharging tray 25. When reading a document fed from the document feeding unit A3 and passing over the second platen 19, the reading carriage 20 is stopped in advance below the second platen 19, and image data is generated from an image passing over the second platen 19.

[Post Processing Apparatus]

The post processing apparatus C is connected to a further downstream side of the sheet folding processing apparatus B connected to the image forming apparatus A, receives the sheet S that has been subjected to folding processing at the sheet folding processing apparatus B or that has not been subjected to folding processing, and performs stapling processing, aligning processing, and the like as necessary.

A post processing path 26 is provided in the post processing apparatus C, and post processing devices (not illustrated) such as a stapling unit and an aligning unit are arranged along the post processing path 26. The post processing apparatus C receives the sheet S discharged from the image forming apparatus A via the sheet folding processing apparatus B, performs stapling processing, aligning processing, and the like on the received sheet S with a post processing device such as a stapling unit and an aligning unit as necessary, and then discharges and stores the sheet S in the storage tray 27.

[Sheet Folding Processing Apparatus]

The sheet folding processing apparatus B connected to the image forming apparatus A is an apparatus that receives the sheet S on which an image is formed discharged from the sheet discharging port 16 of the image forming apparatus A and performs folding processing.

Figure 2:
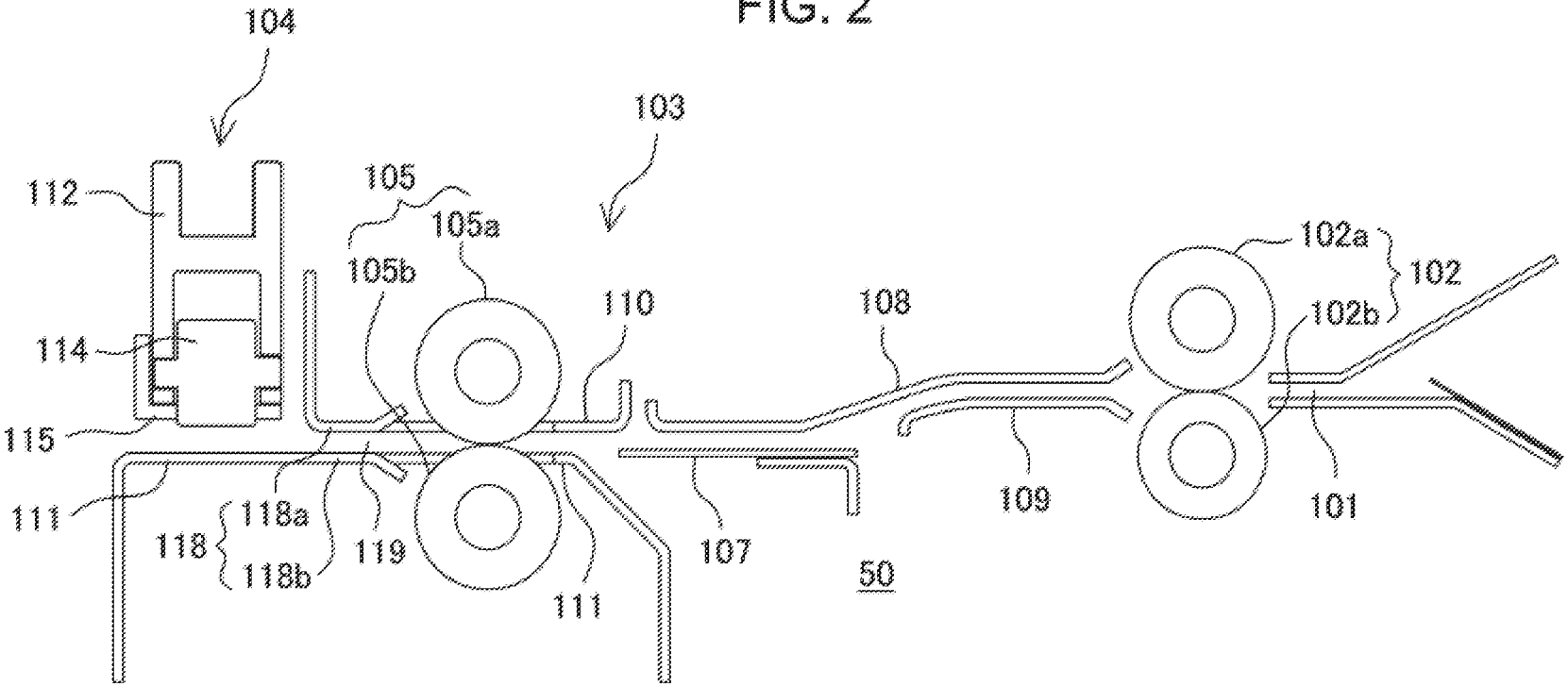
FIG. 2 is an explanatory view of a main portion of a folding processing mechanism and an additional folding unit of the folding processing apparatus illustrated in FIG. 1.

FIG. 2 illustrates an internal configuration of the sheet folding processing apparatus B. A conveyance path 101 extending in a substantially horizontal direction is provided in the sheet folding processing apparatus B. The conveyance path 101 is provided with one or a plurality of conveyance roller pairs 102 and a folding processing mechanism 103, that is, a folding processing unit arranged on a downstream side of the conveyance roller pair 102, and an additional folding unit 104 is further provided at an end part of the conveyance path 101 on a downstream side of the folding processing mechanism 103. The sheet folding processing apparatus B is configured to perform folding processing with the folding processing mechanism 103 on the sheet S conveyed along the conveyance path 101, then perform additional folding processing with the additional folding unit 104, and deliver the sheet S subjected to the folding processing and the additional folding processing to the post processing apparatus C. In the following description, a direction in which the sheet S is conveyed from the conveyance roller pair 102 toward the folding processing mechanism 103 in the conveyance path 101 is referred to as a sheet conveyance direction.

As illustrated in FIG. 1, the conveyance path 101 is arranged so as to be continuous with the sheet discharging port 16 of the image forming apparatus A, and the sheet S discharged from the sheet discharging port 16 can be conveyed into the sheet folding processing apparatus B via the conveyance path 101. The discharging port of the additional folding unit 104 is also arranged so as to be continuous with the post processing path 26 of the post processing apparatus C, and the sheet S discharged from the additional folding unit 104 can be conveyed into the post processing apparatus C via the post processing path 26.

The conveyance roller pair 102 is formed of a rubber roller, and includes an upper conveyance roller 102*a* arranged on an upper side and a lower conveyance roller 102*b* arranged on a lower side to face the upper conveyance roller 102*a*. In the present embodiment, the upper conveyance roller 102*a* is coupled to a conveyance roller driving motor (not illustrated), and is configured to rotate in accordance with rotation of the conveyance roller driving motor, while the lower conveyance roller 102*b* is in pressure contact to the upper conveyance roller 102*a* due to an urging force of a spring (not illustrated), and is configured to rotate in a following manner. However, the conveyance roller pair 102 is not limited to the above-described configuration as long as the sheet S can be conveyed, and an appropriate configuration can be adopted.

The folding processing mechanism 103 is configured of a folding roller pair 105 and a pushing plate 107. The folding roller pair 105 is formed of a rubber roller, and includes an upper folding roller 105*a* arranged on an upper side and a lower folding roller 105*b* arranged on a lower side to face the upper folding roller 105*a*. The lower folding roller 105*b* is in pressure contact to the upper folding roller 105*a* due to an urging force of a spring (not illustrated). The upper folding roller 105*a* and the lower folding roller 105*b* are coupled to a common folding roller driving motor (not illustrated) and rotate in opposite directions to each other in accordance with rotation of the folding roller driving motor. The pushing plate 107 is arranged between the conveyance roller pair 102 and the folding roller pair 105, coupled to a pushing plate driving motor (not illustrated), and moves linearly in the sheet conveyance direction in parallel with the conveyance path 101 on the upstream side of the folding roller pair 105 in accordance with the driving of the pushing plate driving motor.

An upper conveyance guide 108, a lower conveyance guide 109, an upper folding guide 110, and a lower folding guide 111 are provided at the conveyance path 101 between the conveyance roller pair 102 and the folding roller pair 105.

The upper conveyance guide 108 is formed from a position right after the conveyance roller pair 102 to a position above the pushing plate 107 so as to guide a front end of the sheet S from the conveyance roller pair 102 to the pushing plate 107. The upper conveyance guide 108 is for regulating the flow of the sheet S conveyed through the conveyance path 101, is arranged on the upper side of the conveyance path 101, and has a shape bent downward toward the downstream side. The upper folding guide 110 is arranged between the upper conveyance guide 108 and the folding roller pair 105, and extends to a position right before the folding roller pair 105 so as to guide a front end of the sheet S and a folded portion of the sheet S described later to the folding roller pair 105. The upper folding guide 110 is for regulating the flow of the sheet S in the folding processing mechanism 103, and is provided above the conveyance path 101 at the downstream side of the upper conveyance guide 108.

The lower conveyance guide 109 is for regulating the flow of the sheet S conveyed through the conveyance path 101, is arranged below the conveyance path 101, and has a shape bent downward toward the downstream side similarly to the upper conveyance guide 108. The lower conveyance guide 109 is interrupted in front of the pushing plate 107, and an open loop forming space 50 is formed on the downstream side of the lower conveyance guide 109. The lower folding guide 111 is arranged on the downstream side of the pushing plate 107 and extends across the upstream side and the downstream side of the folding roller pair 105. A part of the lower folding guide 111 on the upstream side of the folding roller pair 105 has a horizontal surface for guiding the front end of the conveyed sheet S and the folded portion of the sheet S described later to a nipping portion of the folding roller pair 105 and an inclined surface for facilitating the above guiding to the horizontal surface.

The pushing plate 107 is horizontally moved in the sheet conveyance direction by a controller and a pushing plate driving device (not illustrated) configured of the pushing plate driving motor. The pushing plate driving motor and the controller will be described later in detail in relation to a control configuration of the sheet folding processing apparatus B. The pushing plate 107 is arranged so as to fill the loop forming space 50 between the lower conveyance guide 109 and the lower folding guide 111 when the sheet S is conveyed to the folding roller pair 105 by the conveyance roller pair 102 along the conveyance path 101, and guides the front end of the conveyed sheet to the lower folding guide 111.

When the front end of the conveyed sheet S is nipped by the folding roller pair 105, in order to form the folded portion of the sheet S, the controller causes the pushing plate 107 to move in the horizontal direction to a retracting position below the lower conveyance guide 109, and the loop forming space 50 between the lower conveyance guide 109 and the lower folding guide 111 is opened. Then, when the conveyance roller pair 102 conveys the sheet S by a predetermined amount in a state that the front end of the sheet S is nipped by the folding roller pair 105, an intermediate portion of the sheet S is sagged downward from the conveyance path 101 in the loop forming space 50 to form a loop portion. In this state, the pushing plate 107 is moved in the horizontal direction from the retracting position toward the folding roller pair 105 to form the folded portion, and after the pushing plate 107 reaches the position in front of the folding roller pair 105, the folding roller pair 105 is driven to convey the sheet S, thereby forming a first fold line. Further, after the pushing plate 107 is moved to the retracting position, the sheet S is conveyed by the folding roller pair 105 to nip the loop portion, thereby a second fold line 133 is formed and the Z-folded sheet S is conveyed to the downstream side.

Next, a configuration of the additional folding unit 104 will be described with reference to FIG. 3. The additional folding unit 104 is arranged above the lower folding guide 111 on the downstream side of the folding roller pair 105 in the sheet conveyance direction. The additional folding unit 104 includes a movable support member 112, a plurality of additional folding rollers 114 supported by the support member 112, a regulating member 115 attached to the support member 112, a first moving mechanism 116 that moves the support member 112 in a direction approaching and separating from the lower folding guide 111, and a second moving mechanism 117 that moves the support member 112 in the horizontal direction along a fold line of the sheet S. Parts of the upper folding guide 110 and the lower folding guide 111, which are arranged to face each other in the vertical direction, on the downstream side of the folding roller pair 105 function as a carry-in guide pair 118 that guides the sheet S into the additional folding unit 104. An upstream end part of the carry-in guide pair 118 forms a carry-in port 119 of the additional folding unit 104. An additional folding portion is configured of the plurality of additional folding rollers 114 supported by the support member 112 as described above and the lower folding guide 111.

The plurality of additional folding rollers 114 supported by the support member 112 are arranged in a row, spaced apart from each other at a predetermined interval, in the direction of the fold line of the sheet S in a pressing member arrangement region so that each of the plurality of additional folding rollers is rotatable about a rotation axis line extending in the sheet conveyance direction (a direction parallel to the upper surface of the lower folding guide 111 and perpendicular to the fold line of the sheet S). As described above, since each additional folding roller 114 is supported by the support member 112 such that the rotation axis line of each additional folding roller 114 extends in the sheet conveyance direction, width of each additional folding roller 114 is only required to be a size crossing the fold line in the sheet conveyance direction, and the width in the sheet conveyance direction can be narrowed regardless of the diameter of the additional folding rollers 114. Therefore, the plurality of additional folding rollers 114 can be arranged close to the folding roller pair 105, so that the sheet folding processing apparatus B can be downsized.

Further, the first moving mechanism 116 moves the support member 112 that supports the plurality of additional folding rollers 114 in a direction approaching and separating from the lower folding guide 111. Thus, the plurality of additional folding rollers 114 are moved approaching and separating from the lower folding guide 111, and the plurality of additional folding rollers 114 can be moved between a pressing position at which the fold line of the sheet S positioned between each additional folding roller 114 and the lower folding guide 111 is pressed by each additional folding roller 114 and the lower folding guide 111 and a retracting position at which the plurality of additional folding rollers 114 are moved from the pressing position in a direction separating from the sheet S. The second moving mechanism 117 moves the support member 112 in the horizontal direction (the right-left direction in FIG. 3) at the pressing position, thereby enabling the plurality of additional folding rollers 114 to move along the fold line of the sheet S.

Here, the plurality of additional folding rollers 114 and the lower folding guide 111 are in direct contact with each other if the sheet S is not interposed therebetween at the pressing position. Length of the pressing member arrangement region (i.e., distance between the additional folding rollers 114 arranged at both end positions in the pressing member arrangement region) is determined such that one end portion of the fold line of the sheet S (the end portion on the upstream side in the moving direction of the additional folding roller 114) is arranged between two additional folding rollers 114 arranged adjacent to one end position when moved from the retracting position to the pressing position and that the additional folding roller 114 arranged at the other end position is arranged above the fold line. Preferably, as in the illustrated embodiment, the length of the pressing member arrangement region, that is, the length between the additional folding rollers 114 arranged at both end positions of the pressing member arrangement region is set shorter than length of the fold line of the sheet S conveyed into the additional folding unit 104 by one pitch of the arrangement of the plurality of additional folding rollers 114 (one interval between two additional folding rollers 114 arranged adjacent to each other). In this case, the number of the required additional folding rollers 114 can be reduced, and the cost of the additional folding rollers 114 can be reduced. In addition, since the number of the additional folding rollers 114 supported by the support member 112 is reduced, with respect to a case that same force is applied to the support member 112, pressing force per each additional folding roller 114 against the sheet S is increased, and the additional folding effect is increased. Therefore, efficient additional folding can be performed with smaller force.

In the additional folding unit 104, after the sheet S is received in the additional folding unit 104 in a state that the plurality of additional folding rollers 114 are arranged at the retracting position or a receiving position separated from the pressing position to the retracting position side with respect to the lower folding guide 111, the position of the sheet S is detected by a sheet position detecting unit (not illustrated) provided on the upstream side of the folding roller pair 105 to stop the sheet S when the fold line of the sheet S reaches below the additional folding rollers 114, and the plurality of additional folding rollers 114 are moved, by the first moving mechanism 116, to the pressing position with respect to the lower folding guide 111. The sheet S is conveyed into the additional folding unit 104 such that, when the plurality of additional folding rollers 114 move to the pressing position, one end of the fold line (the upstream end in the direction of movement along the fold line) is arranged between the two additional folding rollers 114 at one end position in the pressing member arrangement region, and that the other end of the fold line (the downstream end in the direction of movement along the fold line) is arranged outside the pressing member arrangement region (i.e., outside the additional folding roller 114 at the other end position in the pressing member arrangement region). Further, through moving the plurality of additional folding rollers 114 along the fold line of the sheet S with respect to the lower folding guide 111 at the pressing position by the second moving mechanism 117, the fold line of the sheet S is pressed over the entire area of the fold line by the plurality of additional folding rollers 114 to perform additional folding, thereby reinforcing the fold line. In this manner, each additional folding roller 114 and the lower folding guide 111 function as a pressing member.

Further, regulating members 115 having a substantially L-shaped cross section and attached to the support member 112 are respectively arranged on the outer side of the additional folding rollers 114 at both end positions and between the additional folding rollers 114 adjacent to each other in a spaced manner. The regulating members 115 are arranged at a regulating position where distance d1 between a bottom surface of the regulating member 115 (i.e., a surface facing the lower folding guide 111) and an upper surface of the lower folding guide 111 is shorter than height of a normal conveyance path, for example, distance d2 between the carry-in guide pair 118 (upper carry-in 118*a* and lower carry-in guide 118*b*) forming the conveyance path following the carry-in port 119 of the additional folding unit 104 during additional folding processing by moving the additional folding rollers 114 along the fold line of the sheet S at the pressing position against the lower folding guide 111. The regulating member 115 moves along the fold line of the sheet S together with the support member 112 while maintaining the distance d1. Here, the distance d1 between the bottom surface of the regulating member 115 and the upper surface of the lower folding guide 111 is determined so that these members do not come into direct contact with each other. According to the above, prior to the pressing by the additional folding rollers 114, the regulating member 115 presses down the fold line so that the height of the fold line is lower than the distance between the upper carry-in guide 118*a* and the lower carry-in guide 118*b*, and the additional folding can be performed by pressing the fold line of the sheet S by the additional folding rollers 114 in such a state.

The gap between the plurality of additional folding rollers 114 and the lower folding guide 111 and the gap between the regulating member 115 and the lower folding guide 111 are each kept constant over the entire region in the direction along the fold line of the sheet S.

It is preferable that each of the plurality of additional folding rollers 114 is rotatably attached to an auxiliary member (not illustrated) movably supported with respect to the support member 112, and springs (not illustrated) are arranged respectively between a spring receiving portion (not illustrated) formed in the support member 112 and an upper end portion of each of the auxiliary members to urge the additional folding rollers 114 toward the lower folding guide 111. With this configuration, when the support member 112 of the additional folding unit 104 and the regulating member 115 attached thereto move downward toward the lower folding guide 111, the additional folding rollers 114 stop moving downward when contacting the lower folding guide 111 via a sheet, while the support member 112 and the regulating member 115 can continue moving downward owing to contraction of the spring, and can stop when the regulating member 115 reaches a regulating position where the distance between the bottom surface of the regulating member 115 and the upper surface of the lower folding guide 111 obtains a desired value. In addition, even when the support member 112 moves along a fold line of the sheet S while being slightly inclined, owing to that each of the auxiliary members is urged by the springs individually, each of the additional folding rollers 114 can apply constant pressing force to the fold line of the sheet S, and it is possible to suppress uneven additional folding due to a change in the pressing force among parts of the fold line.

Next, detailed configurations of the first moving mechanism 116 and the second moving mechanism 117 in the illustrated embodiment will be described.

The support member 112 of the additional folding unit 104 is attached to a slider 124, which is movable along a guide rail 123 fixed to a housing 122 or the like of the sheet folding processing apparatus B, via a bracket 125 so as to be vertically movable, and moves in conjunction with the slider 124 in the horizontal direction. A rack 127 that engages with a pinion (not illustrated) that rotates integrally with a pulley 126 is provided on the slider 124, and the slider 124 can be moved along the guide rail 123 in the horizontal direction by driving an additional folding driving motor 128 and transmitting rotation thereof to the pulley 126 via a belt 129 to rotate the pulley 126.

The support member 112 is formed with a cam groove 131 that engages with a contactor 130 fixed to the housing 122 or the like of the sheet folding processing apparatus B. With the horizontal movement of the support member 112, the cam groove 131 moves while engaging with the contactor 130, and the support member 112 moves while being guided following a shape of the cam groove 131. The cam groove 131 includes a first bottom horizontal portion extending approximately horizontally, a first inclined portion extending obliquely upward from an end of the first bottom horizontal portion, a top horizontal portion extending approximately horizontally from an end of the first inclined portion, a second inclined portion extending obliquely downward from an end of the top horizontal portion, and a second bottom horizontal portion extending approximately horizontally from an end of the second inclined portion.

Figure 3:
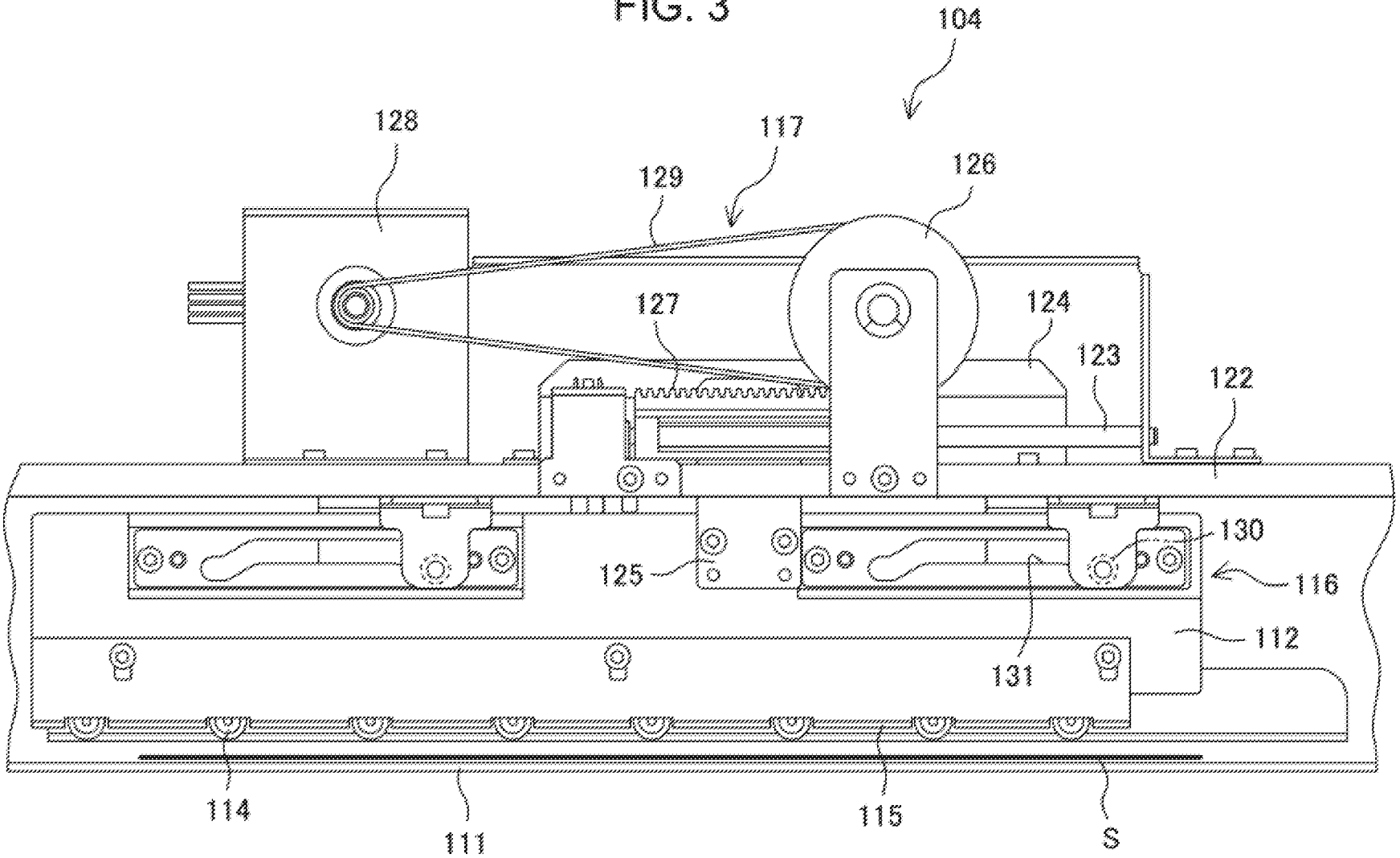
FIG. 3 is a view of the additional folding unit of the folding processing apparatus illustrated in FIG. 1 as viewed from a discharging port side.

By moving the support member 112 in the horizontal direction in FIG. 3 with respect to the housing 122 by the slider 124 while engaging the first inclined portion and the second inclined portion of the cam groove 131 with the contactor 130, the support member 112 moves in a direction approaching and separating from the lower folding guide 111, that is, in the vertical direction in FIG. 3. Thus, the guide rail 123, the slider 124, the bracket 125, the pulley 126, the rack 127, the additional folding driving motor 128, the belt 129, the contactor 130, and the first inclined portion and the second inclined portion of the cam groove 131 constitute a first moving mechanism 116.

By moving the support member 112 in the horizontal direction in FIG. 3 with respect to the housing 122 by the slider 124 while engaging the top horizontal portion of the cam groove 131 with the contactor 130, the support member 112 and the plurality of additional folding rollers 114 supported by the support member 112 move along the fold line of the sheet S in the horizontal direction in FIG. 3 with respect to the lower folding guide 111. Thus, the guide rail 123, the slider 124, the bracket 125, the pulley 126, the rack 127, the additional folding driving motor 128, the belt 129, the contactor 130, and the top horizontal portion of the cam groove 131 constitute a second moving mechanism 117. In the illustrated embodiment, the contactor 130 is fixed to the housing 122 or the like, and the cam groove 131 is formed in the support member 112. However, the contactor 130 may be fixed to the support member 112, and the cam groove 131 may be formed in the housing 122.

In the case that the plurality of additional folding rollers 114 are arranged at regular intervals as in the illustrated embodiment, in order to press all of the fold lines positioned between each of the adjacent additional folding rollers 114 between the additional folding rollers 114 and the lower folding guide 111, it is necessary to move the plurality of additional folding rollers 114 along the fold lines with respect to the lower folding guide 111 at the pressing position by the interval of the adjacent additional folding rollers 114 (i.e., a distance of one pitch) or more. In the above-described configuration of the first moving mechanism 116, by moving the slider 124 in the horizontal direction while engaging the contactor 130 with the first inclined portion of the cam groove 131, the plurality of additional folding rollers 114 supported by the support member 112 approach the lower folding guide 111 and move to the pressing position. In the above-described configuration of the second moving mechanism 117, by moving the slider 124 in the horizontal direction while engaging the contactor 130 with the top horizontal portion of the cam groove 131, the plurality of additional folding rollers 114 supported by the support member 112 move along the fold line at the pressing position. Therefore, length of the top horizontal portion of the cam groove 131 in the horizontal direction (direction along the fold line) is equal to or larger than one pitch of the adjacent additional folding rollers 114.

Next, operation of the additional folding unit 104 of the illustrated embodiment will be briefly described with reference to FIGS. 4A and 4B. Here, description will be given on the assumption that the sheet S having the fold line 132 formed at a front end thereof by the folding roller pair 105 is conveyed into the additional folding unit 104.

Figure 4A:
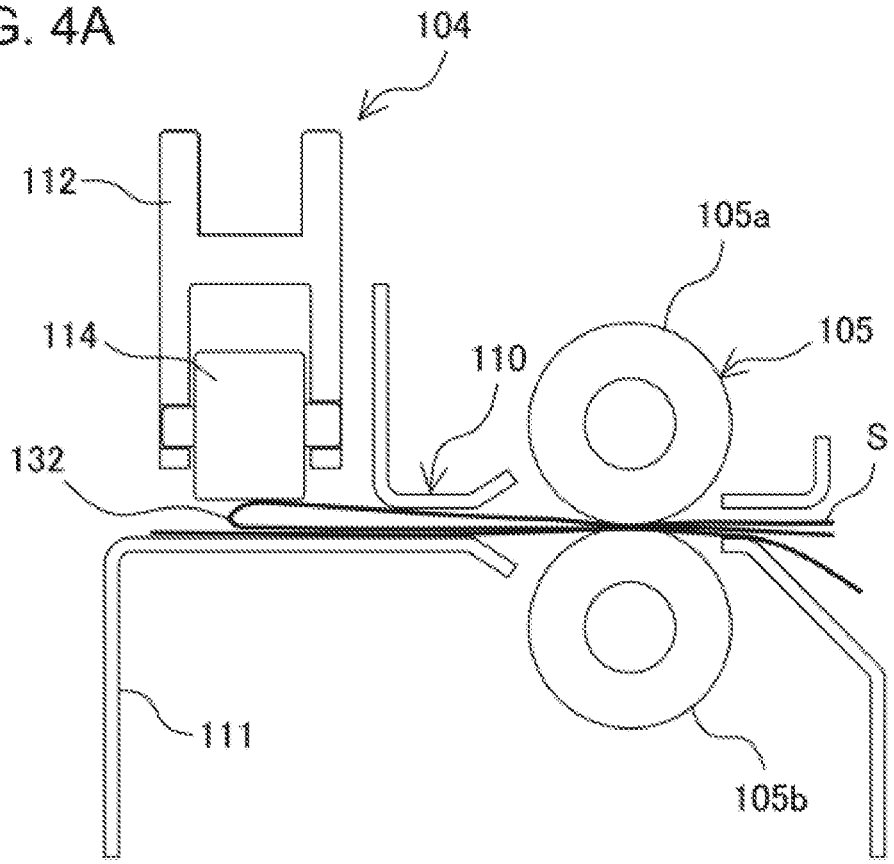
FIGS. 4A and 4B are views for explaining operation of the additional folding unit illustrated in FIG. 3.

When the sheet S from the folding processing mechanism 103 is received into the additional folding unit 104 through the conveyance path constituted by the carry-in port 119, the upper carry-in guide 118*a*, and the lower carry-in guide 118*b*, as illustrated in FIG. 4A, the plurality of additional folding rollers 114 supported by the support member 112 are arranged at the receiving position which is the home position. When the position of the sheet S is detected by a sheet position detecting unit (not illustrated) provided on the upstream side of the folding roller pair 105 and it is recognized that the first fold line 132 on the front end side in the sheet conveyance direction of the sheet S conveyed into the carry-in port 119 from the folding roller pair 105 reaches the pressing position below the additional folding rollers 114 as illustrated in FIG. 4A, the conveyance of the sheet S is stopped and the support member 112 is moved in the horizontal direction together with the slider 124 by driving the additional folding driving motor 128. Thus, the portion where the contactor 130 engages with the cam groove 131 moves from the first bottom horizontal portion to the first inclined portion, and thereby the support member 112 moves downward toward the lower folding guide 111, and as illustrated in FIG. 4B, the plurality of additional folding rollers 114 supported by the support member 112 move to the pressing position where the first fold line 132 of the sheet S is nipped and pressed between the plurality of additional folding rollers 114 and the lower folding guide 111.

Figure 4B:
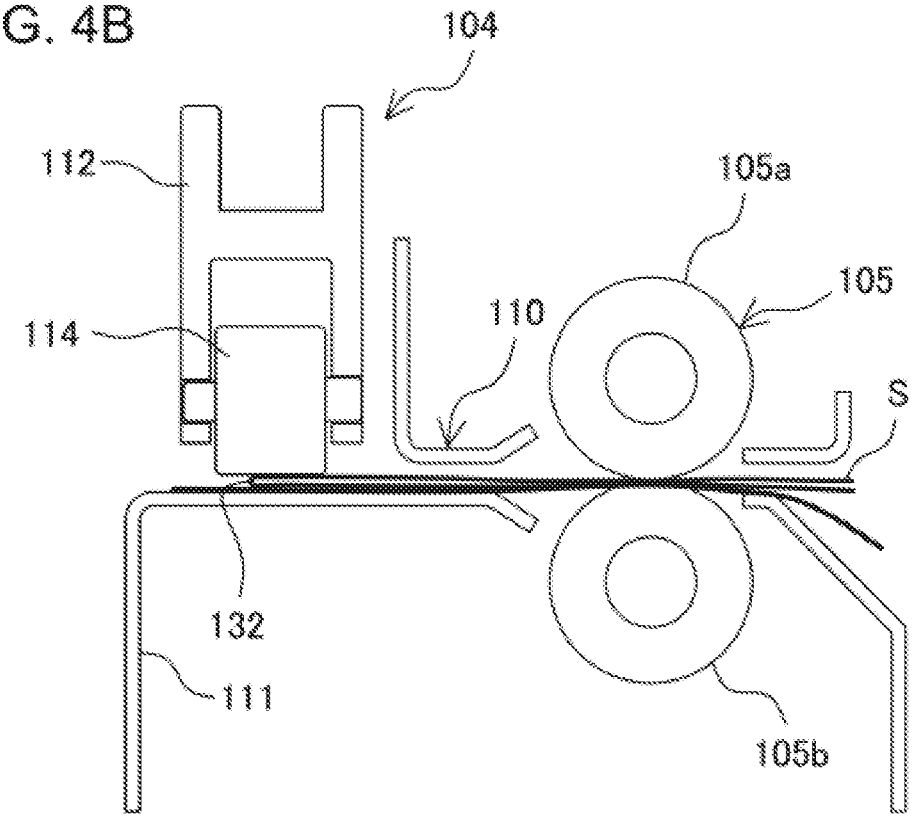

When the support member 112 is further moved in the horizontal direction together with the slider 124 by driving the additional folding driving motor 128 from the state illustrated in FIG. 4B, the portion where the contactor 130 engages with the cam groove 131 moves from the first inclined portion to the top horizontal portion. Then, while the regulating member 115 attached to the support member 112 regulates thickness of the first fold line 132 of the sheet S to a predetermined thickness (corresponding to the distance d1) or less, the plurality of additional folding rollers 114 supported by the support member 112 move at the pressing position along the fold line 132 of the sheet S with respect to the lower folding guide 111 by distance equal to or larger than one pitch of the plurality of additional folding rollers 114, and the leading additional folding roller 114 in the moving direction moves over the other end of the first fold line 132 of the sheet S (a downstream side end in the moving direction of the additional folding rollers 114 in the outward route). In this manner, the fold line 132 is pressed over the entire area by the additional folding rollers 114 and the lower folding guide 111 to reinforce the fold line 132, that is, to perform additional folding.

When the support member 112 is further moved in the horizontal direction together with the slider 124 by driving the additional folding driving motor 128 from this state, the portion where the contactor 130 engages with the cam groove 131 moves from the top horizontal portion to the second bottom horizontal portion via the second inclined portion. As a result, the support member 112 rises together with the regulating member 115 in a direction separating from the lower folding guide 111, and the plurality of additional folding rollers 114 supported by the support member 112 move to the first retracting position located above while approaching the position where the pressing is finished, and the additional folding processing is completed. Here, the first retracting position is different from the receiving position, which is the home position.

[Control Configuration of Sheet Folding Processing Apparatus]

Figure 5:
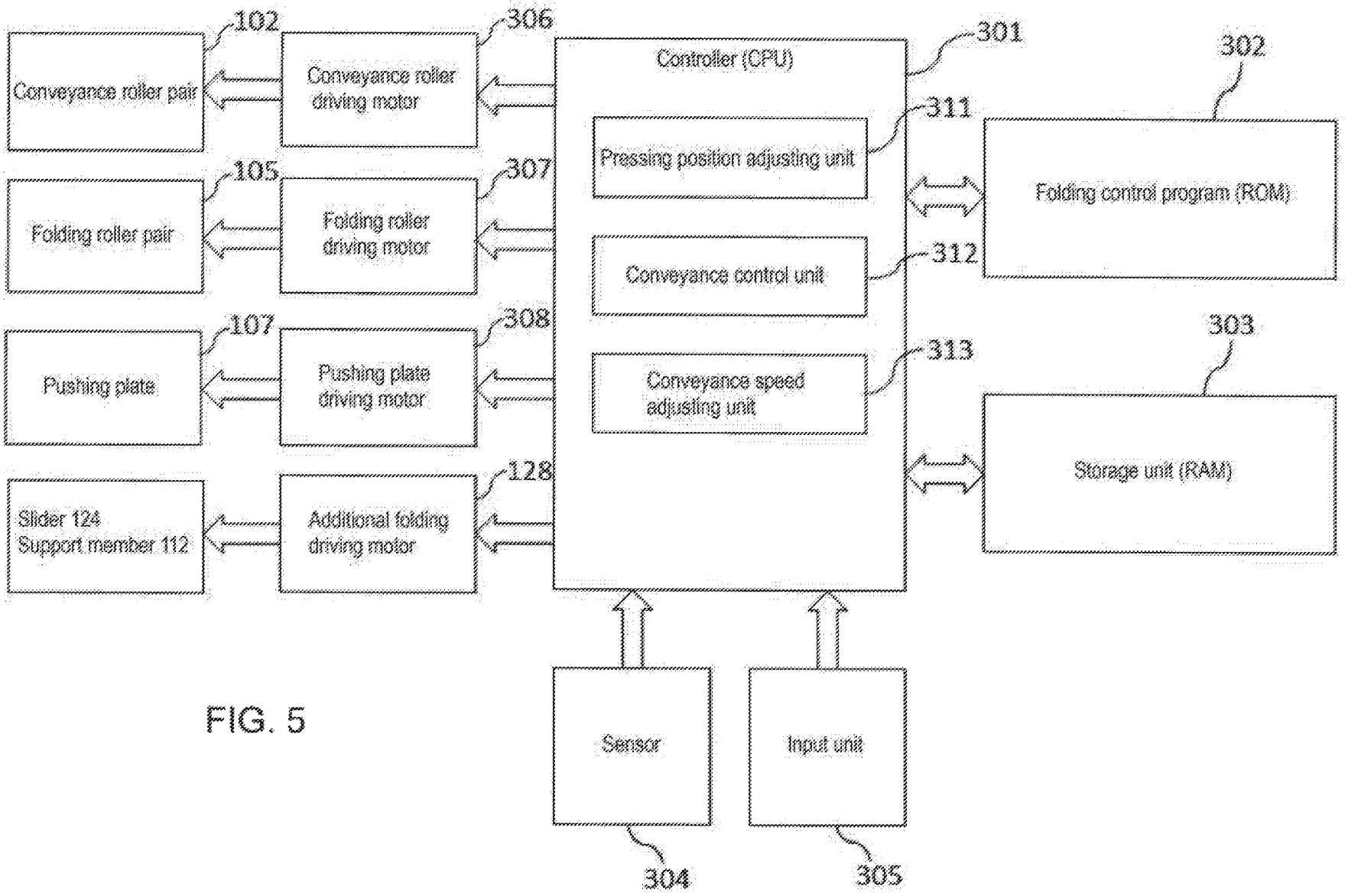
FIG. 5 is a block diagram of a control configuration of the folding processing apparatus.

FIG. 5 conceptually shows a control configuration of the sheet folding processing apparatus B. The sheet folding processing apparatus B includes a controller 301 configured of a control board including a CPU. The controller 301 includes a pressing position adjusting unit 311, a conveyance control unit 312, and a carry-in speed adjusting unit 313.

As illustrated in FIG. 5, sensors 304 provided along the conveyance path 32 are connected to the controller 301. The sensors 304 include a sheet position detection sensor (not illustrated) which detects a front end and a rear end of a conveyed sheet and a sensor (not illustrated) which detects a position of the pushing plate 107. The detection results thereof are output to the controller 301 in real time.

Further, an input unit 305 and a display unit (not illustrated) provided on a setting panel of the image forming apparatus A are connected to the controller 301 via the main body controller (not illustrated) of the image forming apparatus A. The input unit 305 includes an input interface such as a switch to enable, for example, an operation on the controller 301. Information such as a type of sheets set by the user on the setting panel and the folding processing mode executed by the sheet folding processing apparatus B is transmitted from the image forming apparatus A to the controller 301 via the main body controller.

The controller 301 is connected to a conveyance roller driving motor 306, a folding roller driving motor 307, a pushing plate driving motor 308, and an additional folding driving motor 128. Based on the detection results input from the sensors 304 and the above-described various information received from the image forming apparatus A, the driving of each driving motor is controlled to drive the conveyance roller pair 102, the folding roller pair 105, the pushing plate 107, the slider 124, and the support member 112, thereby controlling and executing the sheet conveyance, the folding processing, and the additional folding processing in the sheet folding processing apparatus B.

Further, the controller 301 is connected to a ROM 302 storing a folding control program and a storage unit 303 configured of a RAM. The folding control program is called from the ROM 302, and the above-described processing is executed while storing temporary information in the storage unit 303 as necessary.

The folding processing and the additional folding processing of the sheet folding processing apparatus B will be specifically described below with reference to a flowchart illustrated in FIGS. 6A to 8I. FIGS. 6A to 6C, FIGS. 7D to 7F, and FIGS. 8G to 8I illustrate processing in which the sheet folding processing apparatus B receives a sheet from the image forming apparatus A, conveys the sheet, and performs the folding processing and the additional folding processing in order of steps. The folding processing and the additional folding processing are executed according to, for example, the procedure shown in the flowchart of FIG. 9.

Figure 6A:
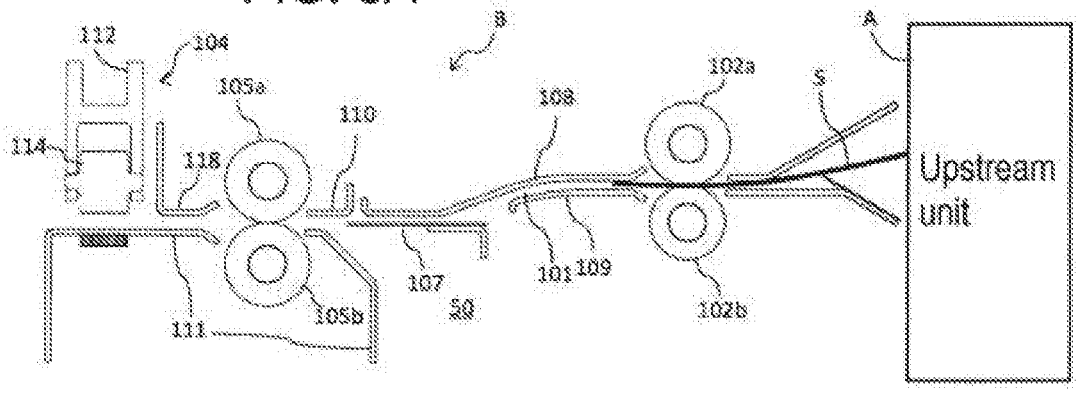
FIGS. 6A to 6C are views for explaining folding processing of a first embodiment by the folding processing apparatus in the order of steps.

When a predetermined time elapses after detecting the front end of the sheet S conveyed from the image forming apparatus A in a state that the conveyance roller pair 102 stops rotating, the controller 301 drives the conveyance roller driving motor 306 to cause the conveyance roller pair 102 to be rotated, receive the sheet S as illustrated in FIG. 6A, and start conveyance (step St71). The predetermined time in step St71 is a time necessary and sufficient for the front end of the sheet S to come into contact with the nipping portion of the conveyance roller pair 102 to align the front end position.

Figure 6B:
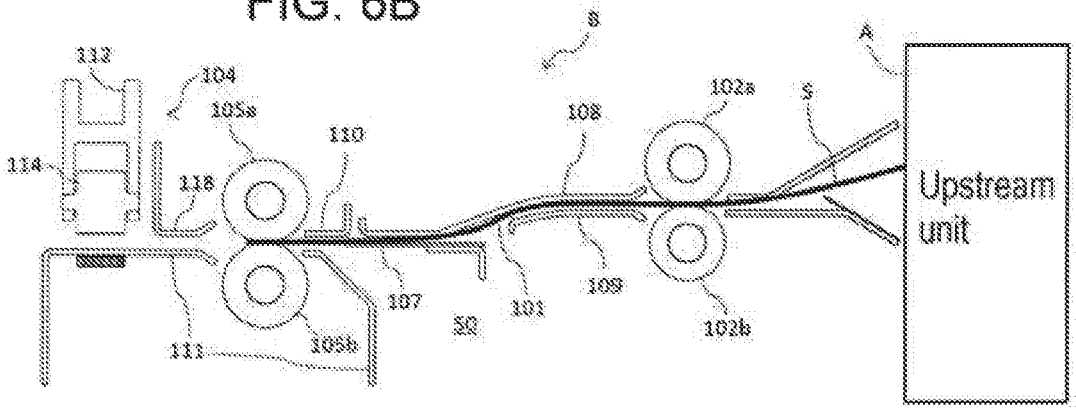

In a state that the pushing plate 107 is arranged, between the conveyance roller pair 102 and the folding roller pair 105, at a position to close the loop forming space 50, the conveyance roller pair 102 and the folding roller pair 105 are rotated to convey the sheet S along the conveyance path 101, and as illustrated in FIG. 6B, after the front end of the sheet S passes through the folding roller pair 105 by a predetermined distance, the folding roller pair 105 is stopped (step St72). Thus, the sheet S is held in a state in which the front end thereof is nipped by the folding roller pair 105.

Figure 6C:
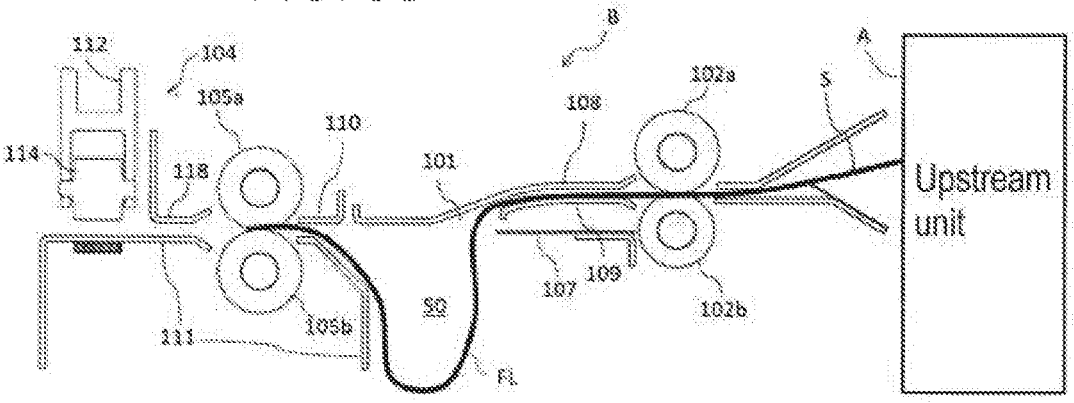

Next, the controller 301 drives the pushing plate driving motor 308 to move the pushing plate 107 to the retracting position below the lower conveyance guide 109, and open the loop forming space 50 to the conveyance path 101 (step St73). Thereafter, since the conveyance roller pair 102 continues to rotate, as illustrated in FIG. 6C, a portion of the sheet S on the upstream side of the folding roller pair 105 is curved in a loop shape from the conveyance path 101 and hangs down into the loop forming space 50, and a folding loop FL for forming a fold line on the sheet is formed. Thereafter, the folding loop FL is enlarged in accordance with the amount of the sheet S fed by the conveyance roller pair 102.

Figure 7D:
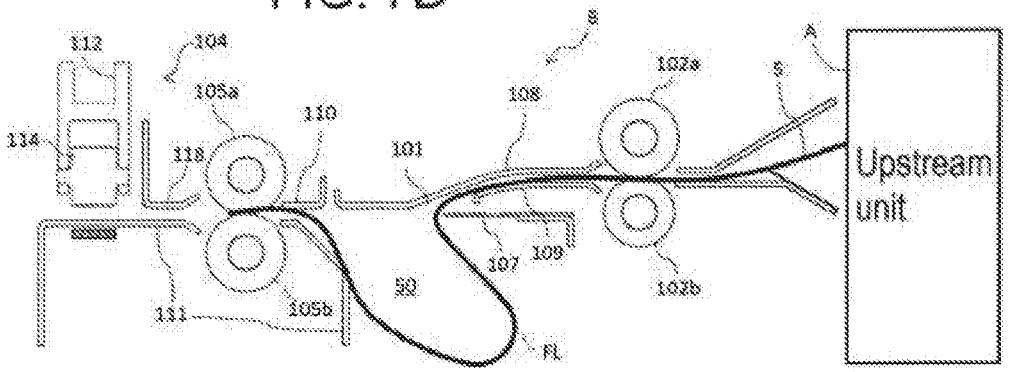
FIGS. 7D to 7F are views for explaining the folding processing following FIG. 6C in the order of steps.

Then, the controller 301 starts pushing processing in step St74. At this time, in the loop forming space 50, as illustrated in FIG. 7D, the folding loop FL having a size suitable for forming a fold line on the sheet S at a predetermined folding position is formed by the continuous feeding of the sheet S by the conveyance roller pair 102.

Figure 7E:
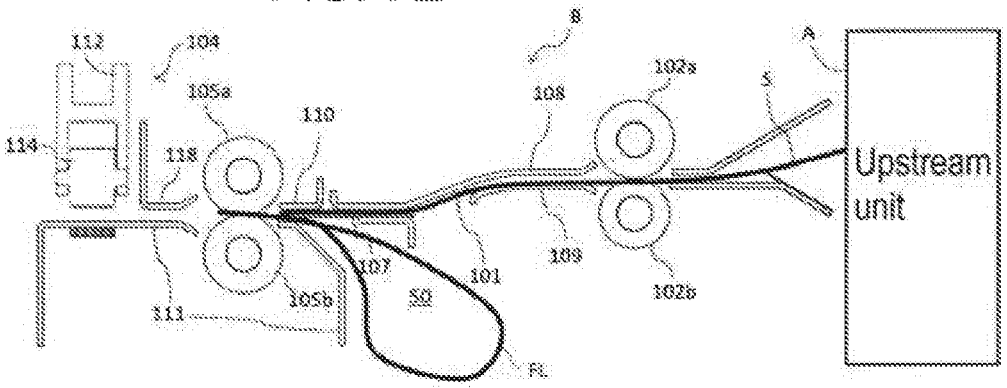

In the pushing processing, the pushing plate 107 is moved horizontally toward the folding roller pair 105, and the front end thereof is brought into contact with the folding loop FL. Further, the pushing plate 107 moves to a position right before the nipping portion of the folding roller pair 105, as illustrated in FIG. 7E, while pushing a predetermined position of the sheet S by the front end thereof. At this time, the front end part of the sheet S pushed by the front end of the pushing plate 107 is temporarily folded at a folding position which is to be a first fold line of the sheet S.

Figure 7F:
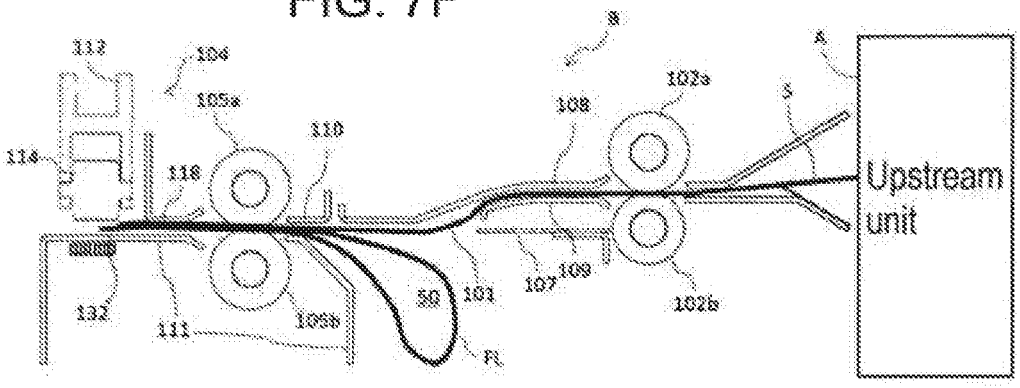

Then, as the folding roller pair 105 is rotated, the folding position which is to be the first fold line of the sheet S is drawn into the nipping portion of the folding roller pair 105, and is pressurized and folded between the upper and lower folding rollers 105*a* and 105*b* while being conveyed to the downstream side. Through the above pressurizing processing, as illustrated in FIG. 7F, the first fold line 132 is formed at the predetermined folding position on the sheet S (step St75). The pushing plate 107 is moved to the retracting position below the lower conveyance guide 109 so as not to prevent the sheet S from being drawn into the nipping portion of the folding roller pair 105. Thus, the loop forming space 50 below the conveyance path 101 is opened again.

The folding roller pair 105 continues to be rotationally driven even after the pushing plate 107 is retracted. Therefore, as illustrated in FIG. 7F, the sheet S is nipped by the folding roller pair 105 in a state that the sheet S is triple folded (Z-folded) with the front end in the sheet conveyance direction and the first fold line 132 formed by the folding roller pair 105 oriented in front, and is conveyed to the downstream side.

Figure 8G:
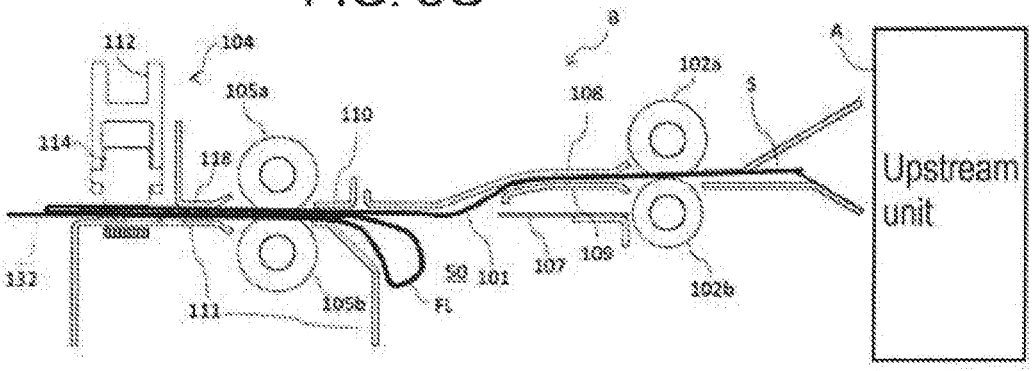
FIGS. 8G to 8I are views for explaining additional folding processing following FIG. 7F in the order of steps.
Figure 9:
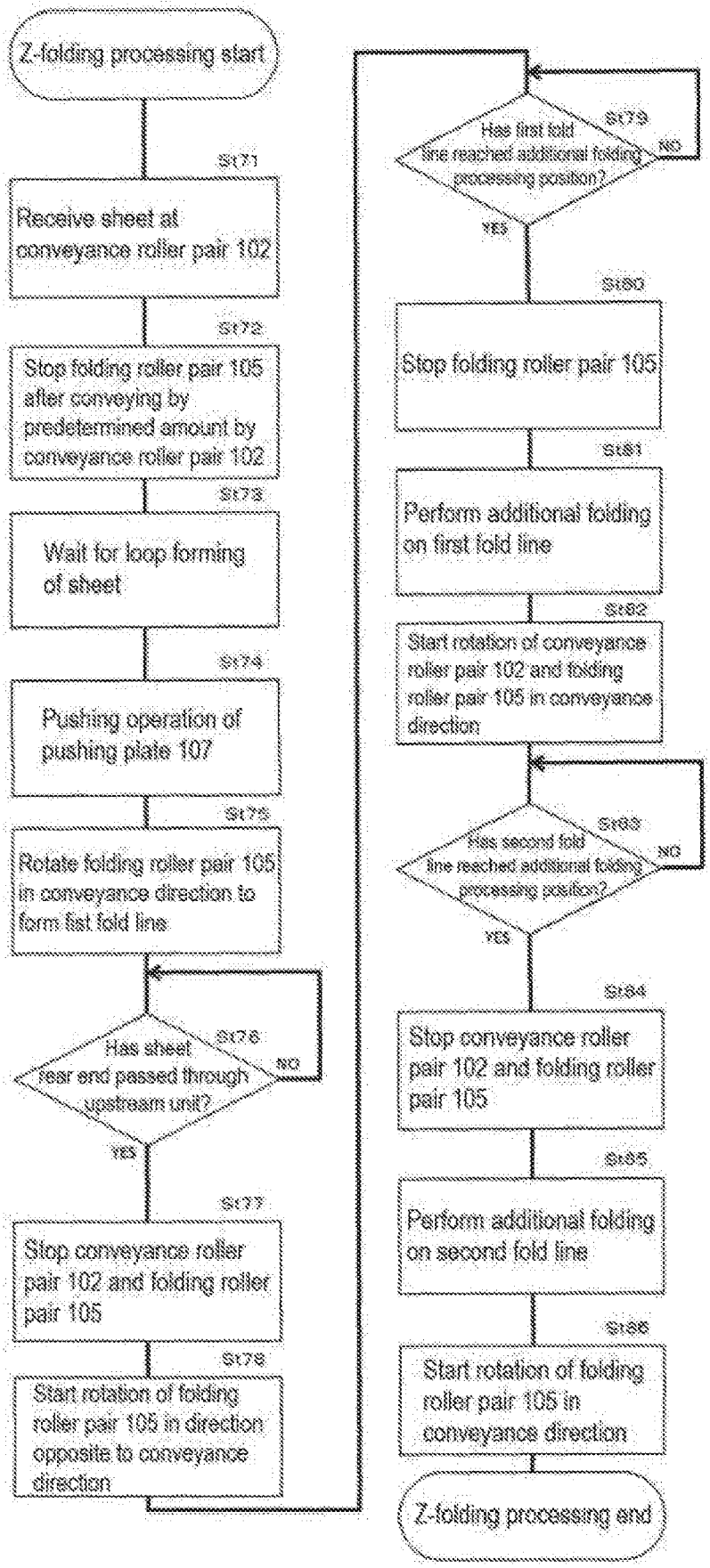
FIG. 9 is a flowchart for explaining operation in FIGS. 6A to 8I.

After the rear end of the sheet S in the sheet conveyance direction passes through the ejecting port of the image forming apparatus A which is an upstream unit and is completely conveyed into the sheet folding processing apparatus B (step St76), as illustrated in FIG. 8G, the folding roller pair 105 and the conveyance roller pair 102 are stopped when the first fold line 132 passes through the additional folding processing position and is fed to the downstream side by a predetermined conveyance amount (step St77). Here, the additional folding processing position is a position in the sheet conveyance direction at which a fold line of the sheet S is positioned to perform the additional folding processing between the additional folding roller 114 and the lower folding guide 111.

The predetermined conveyance amount of the feeding, from the additional folding processing position, to the downstream side in the sheet conveyance direction until the first fold line 132 of the sheet S stops is determined by the sheet length of the sheet S in the sheet conveyance direction, and can be changed in accordance with the length. In the present embodiment, as described above, the predetermined conveyance amount is determined in accordance with the length of the sheet S in the sheet conveyance direction so that the rear end of the sheet S in the sheet conveyance direction passes through the upstream unit and is completely conveyed into the sheet folding processing apparatus B when the folding roller pair 105 and the conveyance roller pair 102 are stopped in step St77. The controller 301 can receive length information of the sheet S in the sheet conveyance direction from the main body controller of the image forming apparatus A in advance, and alternatively, can detect the front end and the rear end of the conveyed sheet S by the sheet position detection sensor included in the above-described sensors 304 and calculate the length information from the time difference.

Figure 8H:
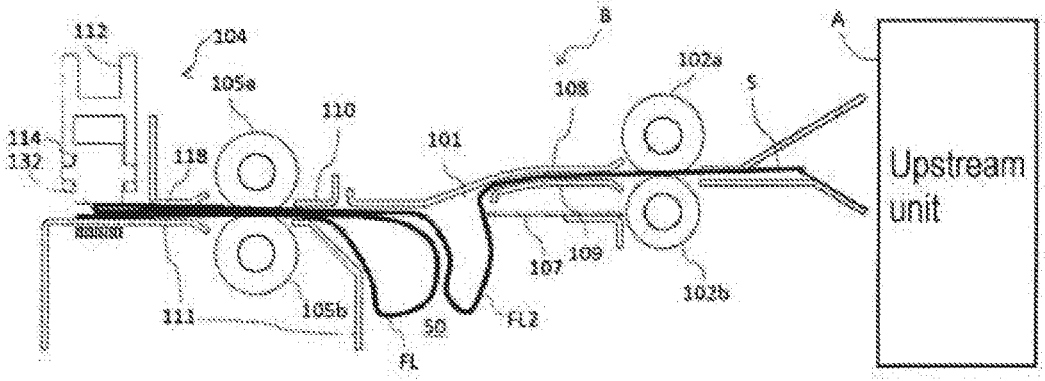

Then, as illustrated in FIG. 8H, the folding roller pair 105 is reversely rotated in a state that the conveyance roller pair 102 is stopped, and the sheet S is moved to the upstream side in the sheet conveyance direction (step St78). When the first fold line 132 of the sheet S is returned to the additional folding position (step St79), the folding roller pair 105 is stopped (step St80), and the first fold line 132 is positioned at the additional folding position.

At this time, since the conveyance roller pair 102 is stopped, a sag is generated at the sheet S between the conveyance roller pair 102 and the folding roller pair 105, and the sheet S hangs down from the conveyance path 101 to the loop forming space 50 to form a second loop FL2 above the loop FL. As described above, since two loops FL, FL2 are formed in the single loop forming space 50, the apparatus is not unnecessarily increased in size, and the apparatus can be reduced in size and cost.

In this state, the controller 301 drives the additional folding driving motor 128, and causes the additional folding roller 114 and the lower folding guide 111 to perform the additional folding processing of the first fold line 132 (step St81). When the additional folding processing is completed, the conveyance roller pair 102 and the folding roller pair 105 are rotated to convey the sheet S to the downstream side (step St82).

Here, when the conveyance of the sheet S to the downstream side is started, each activation of the conveyance roller pair 102 and the folding roller pair 105 may be started with a time difference. Specifically, for example, the folding roller pair 105 is activated first, and then the conveyance roller pair 102 is activated after a predetermined time has elapsed. Due to setting an appropriate time difference between the activation start of the conveyance roller pair 102 and that of the folding roller pair 105, the second loop FL2 formed in the loop forming space 50 can be eliminated or reduced. Alternatively, the second loop FL2 may be formed after the loop FL is drawn into the folding roller pair 105. Here, the time difference may also be set by being replaced it with the rotation amounts of the conveyance roller pair 102 and the folding roller pair 105, the rotation amounts of the motors for the driving thereof, the sheet conveyance amounts, or the like.

As the sheet S is conveyed to the downstream side, the folding loop FL in the loop forming space 50 gradually becomes smaller, and the sheet S is folded into two from the upper and lower sides at a desired folding position where the second fold line 133 is to be formed. The folding position of the sheet S to be the second fold line 133 is conveyed in such a bent form, and is pressurized and folded by the nipping portion of the folding roller pair 105, so that the second fold line 133 is formed at the desired position.

In the present embodiment, in steps St77 and St78, the rear end position of the sheet S in the sheet conveyance direction is adjusted so that the sheet S completely passes through the image forming apparatus A at the time when the folding roller pair 105 and the conveyance roller pair 102 are stopped after the first fold line 132 passes through the additional folding position and the sheet S is conveyed to the downstream side. However, in the present invention, rotation control of the conveyance roller pair 102 related to the reverse rotation of the folding roller pair 105 in steps St77 and St78 and that of the additional folding processing are not limited to the above.

In another embodiment, in step St77 described with reference to FIG. 8G, the controller 301 may stop the folding roller pair 105, and continue to rotate the conveyance roller pair 102 to feed the rear end of the sheet S downstream in the sheet conveyance direction even thereafter. The conveyance of the rear end side of the sheet S by the conveyance roller pair 102 may be performed selectively during all or a part of the period until the folding roller pair 105 is reversely rotated in step St78 after once stopped and a until the folding roller pair 105 is once stopped and then reversely rotated and the first fold line 132 is returned to the additional folding position and stopped in step St 78 and the period until the additional folding processing is further performed and the processing proceeds to the next step St82.

As a result, it is possible to adjust, along the sheet conveyance direction, the rear end position of the sheet S at the time when the additional folding processing of the first fold line 132 is completed and the conveyance of the sheet S to the downstream side is started (step St82). For example, depending on the length of the sheet S in the sheet conveyance direction, the rear end of the sheet S in the sheet conveyance direction may not be completely conveyed into the sheet folding processing apparatus B when the folding roller pair 105 is stopped in step St77 and may be positioned in the image forming apparatus A which is the upstream unit. Even in this case, by controlling the rotation of the conveyance roller pair 102 as described above, the rear end of the sheet S in the sheet conveyance direction can completely pass through the image forming apparatus A at the latest when the additional folding processing of the first fold line 132 is completed. Accordingly, as described above, it is possible to maintain and improve the productivity of the entire image forming system including the sheet folding processing apparatus B.

In another embodiment, in steps St77 and St78, the controller 301 may once stop and then reversely rotate the conveyance roller pair 102 as well to convey the rear end side of the sheet S to the upstream side in the sheet conveyance direction at the time when stopping and reversely rotating the folding roller pair 105 to convey the sheet S to the upstream side in the sheet conveyance direction. In this case, the conveyance roller pair 102 and the folding roller pair 105 are controlled so that sheet conveyance amount by the reverse rotation of the conveyance roller pair 102 is less than sheet conveyance amount by the reverse rotation of the folding roller pair 105.

Thus, formation of the second loop FL2 in the loop forming space 50 can be eliminated or reduced in size. In this case, the rear end of the sheet S in the sheet conveyance direction moves toward the image forming apparatus A which is the upstream unit. However, in this embodiment as well, it is preferable from a viewpoint of productivity of the entire system described above that the rear end of the sheet S is completely discharged from the image forming apparatus A at the latest when the additional folding processing of the first fold line 132 is completed.

Here, the sheet conveyance amounts with the reverse rotation of the conveyance roller pair 102 and that of the folding roller pair 105 may be set based on conveyance distance of the sheet S in the sheet conveyance direction, conveyance time, rotation amounts (rotation speed, rotation time) of the conveyance roller pair 102 and the folding roller pair 105, and the like. Further, start and/or stop of the reverse rotation of the conveyance roller pair 102 and the folding roller pair 105 are not necessarily performed at the same time. For example, the start of the reverse rotation of the conveyance roller pair 102 may be delayed from the start of the reverse rotation of the folding roller pair 105, or the stop of the reverse rotation of the conveyance roller pair 102 may be advanced from the stop of the reverse rotation of the folding roller pair 105.

Figure 8I:
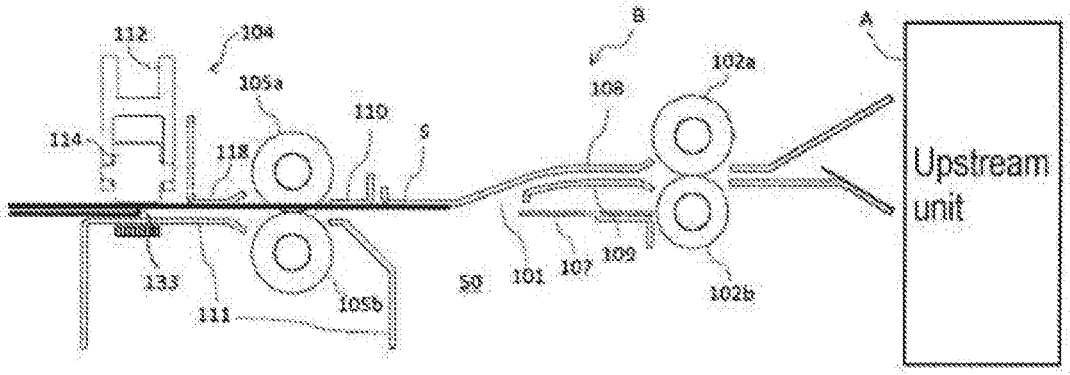

Next, as illustrated in FIG. 8I, when the second fold line 133 of the sheet S reaches the additional folding processing position (step St83), the folding roller pair 105 and the conveyance roller pair 102 are stopped (step St84), and the second fold line 133 is positioned at the additional folding processing position. In this state, the controller 301 drives the additional folding driving motor 128, and causes the additional folding roller 114 and the lower folding guide 111 to perform the additional folding processing of the second fold line 133 (step St85). When the additional folding processing is completed, the folding roller pair 105 is rotated to convey the sheet S to the downstream side (step St86), and the sheet S is discharged to the post processing apparatus C at the downstream side.

Thus, the folding processing and the additional folding processing in series are completed in the sheet folding processing apparatus B. At this time, in steps St76 and St77, since the rear end of the sheet S is completely discharged to the sheet folding processing apparatus B side, the image forming apparatus A on the upstream side is ready to feed a subsequent sheet to the sheet folding processing apparatus B, and productivity of the entire system is improved and maintained.

Further, when the sheet length in the sheet conveyance direction is short, the rear end of the sheet S may be discharged from the image forming apparatus A before the first fold line 132 passes through the additional folding processing position. In this case, the controller 301 performs the additional folding processing by stopping the folding roller pair 105 while aligning the position of the first fold line 132 of the sheet S with the additional folding processing position so that the first fold line 132 does not pass through the additional folding processing position. The controller 301 can recognize in advance that the length of the sheet S in the sheet conveyance direction is short, by detecting the front end and the rear end of the sheet S conveyed through the conveyance path 101 by the sheet position detecting sensor as described above and calculating the length from the time difference, or based on the length information of the sheet S in the sheet conveyance direction received from the main body controller of the image forming apparatus A.

Figure 10A:
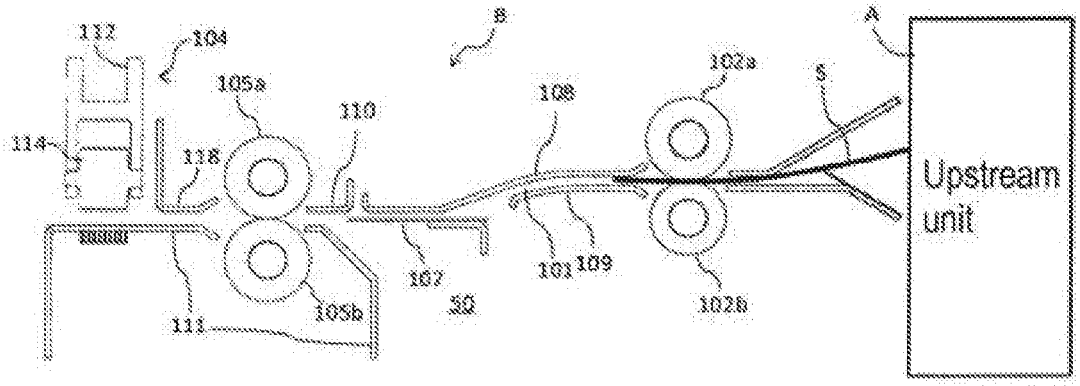
FIGS. 10A to 10C are views for explaining folding processing of a second embodiment by the folding processing apparatus in the order of steps.
Figure 10B:
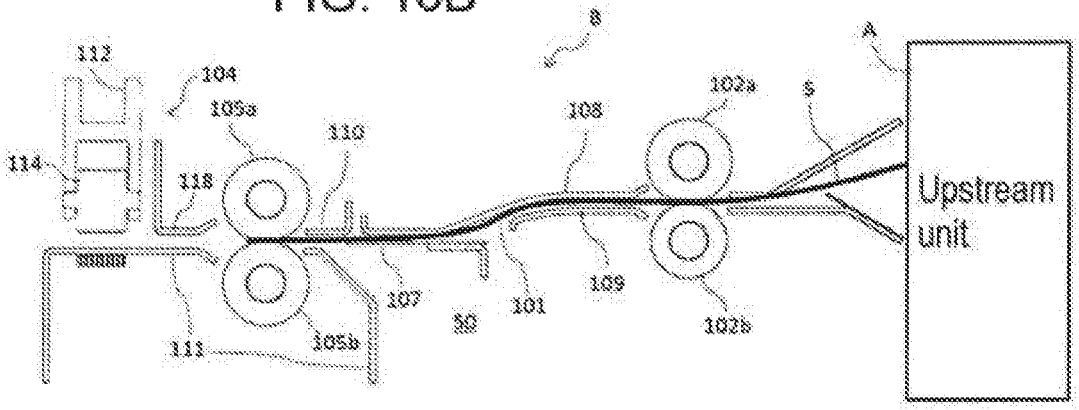
Figure 10C:
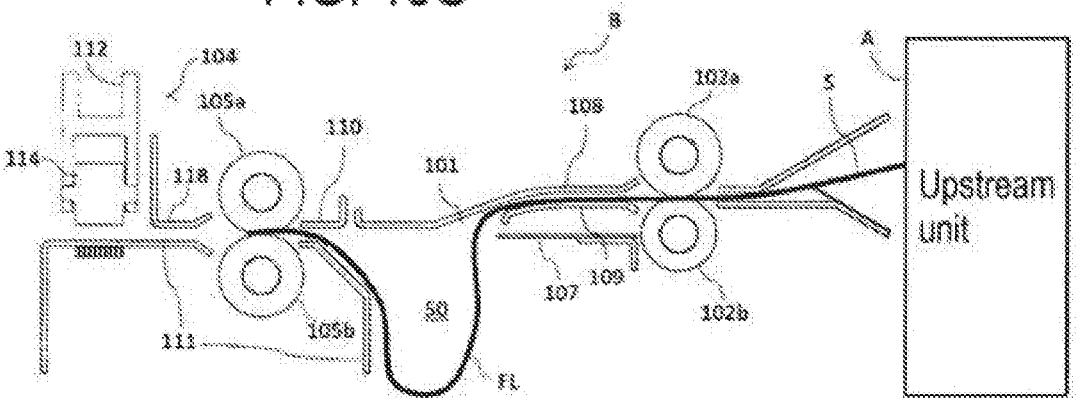
Figure 11D:
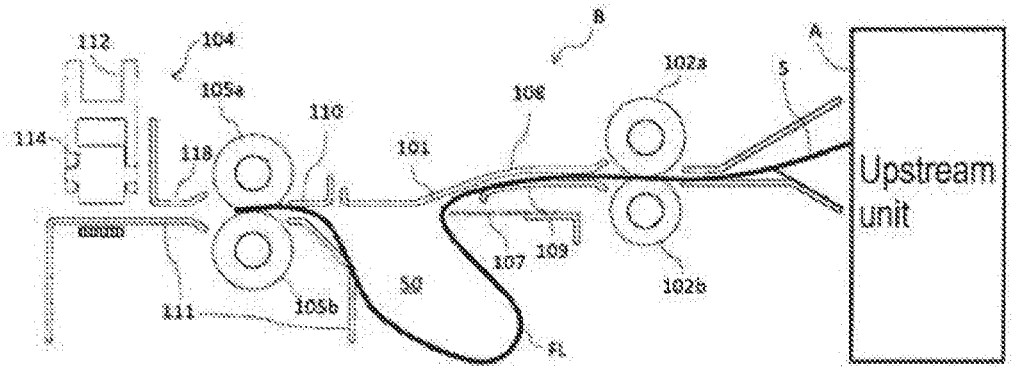
FIGS. 11D to 11F are views for explaining the folding processing following FIG. 10C in the order of steps.
Figure 11E:
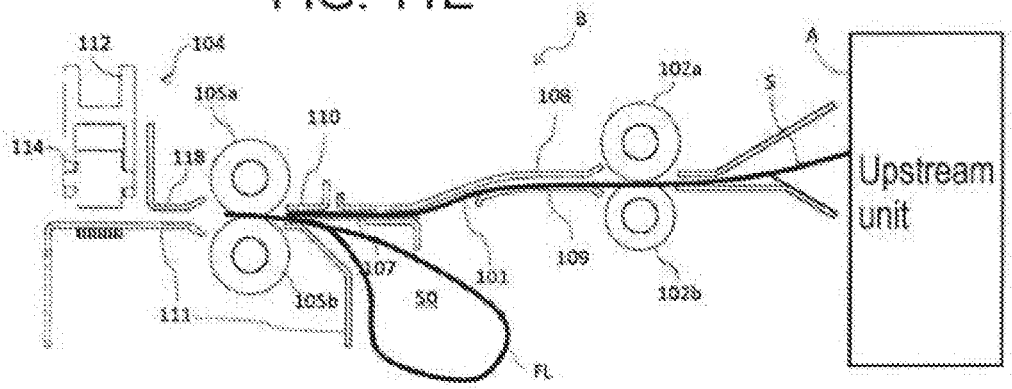

FIGS. 10 to 12 illustrate a second embodiment of the folding processing and the additional folding processing performed by the sheet folding processing apparatus B. The above processing may be performed according to the procedure shown in the flowchart of FIG. 13, for example.

Figure 13:
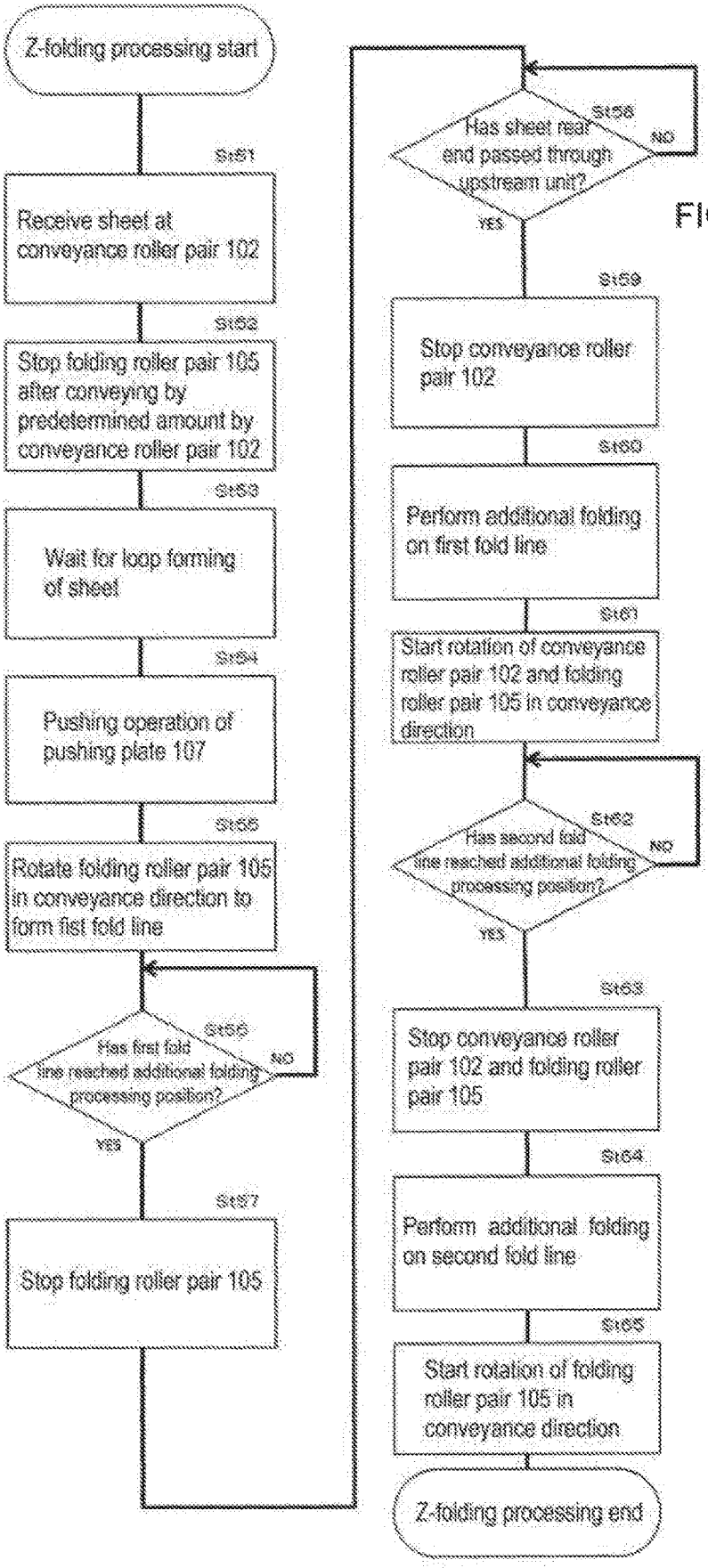
FIG. 13 is a flowchart for explaining operation in FIGS. 10A to 12I.

Here, since the folding processing of FIGS. 10A to 10C and FIGS. 11D to 11F is the same as the folding processing of FIGS. 6A to 6C and FIGS. 7D to 7F in the first embodiment, description thereof will be omitted. Similarly, since processing of steps St51 to St55 of FIG. 13 is also the same as processing of steps St71 to St75 of FIG. 9 in the first embodiment, description thereof will be omitted.

Figure 11F:
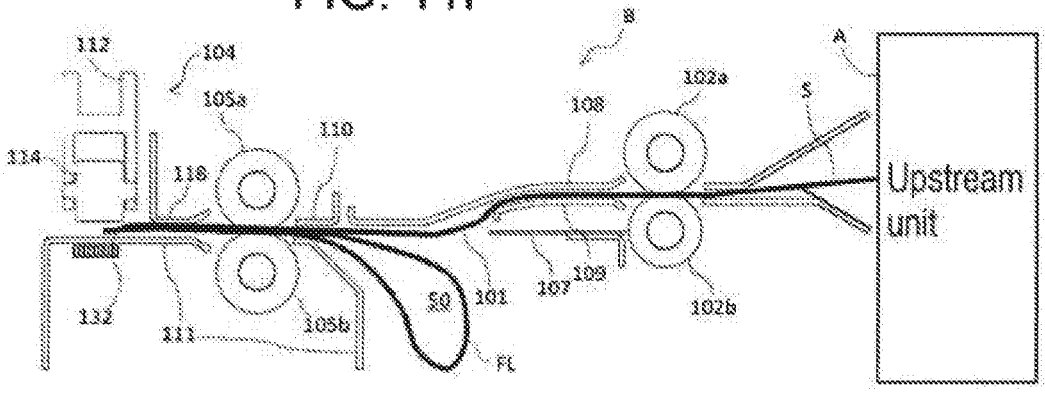
Figure 12G:
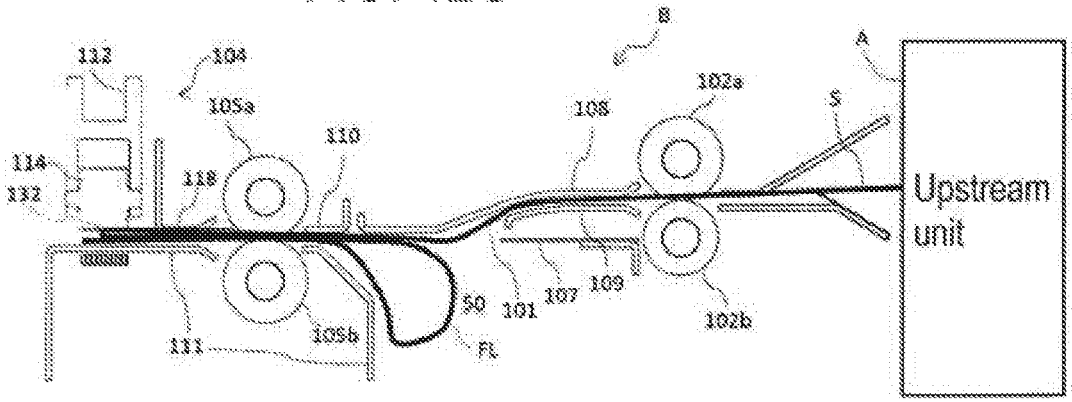
FIGS. 12G to 12I are views for explaining additional folding processing following FIG. 11F in the order of steps.

After the first fold line 132 is formed at step St55 as illustrated in FIG. 11F, when the first fold line 132 reaches the additional folding processing position (step St56) as illustrated in FIG. 12G, the folding roller pair 105 is stopped (step St57), and the first fold line 132 is positioned at the additional folding processing position. At this time, the conveyance roller pair 102 continues to rotate and conveys the sheet S to the downstream side. When the rear end of the sheet S is discharged from the image forming apparatus A (step St58), the conveyance roller pair 102 is stopped (step St59). Thus, a sag is generated in the sheet S between the conveyance roller pair 102 and the folding roller pair 105, and the sheet S hangs down from the conveyance path 101 to the loop forming space 50 to form a second loop FL2 above the loop FL.

Figure 12H:
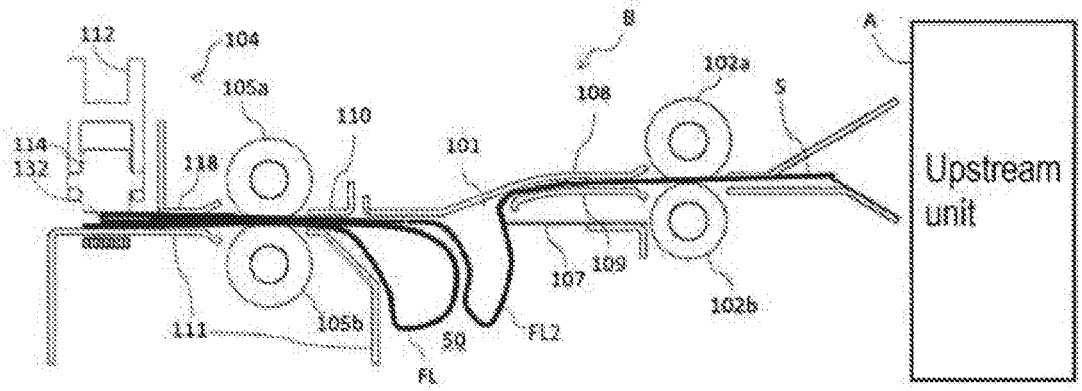

In this state, the controller 301 drives the additional folding driving motor 128, and causes the additional folding roller 114 and the lower folding guide 111 to performs the additional folding processing of the first fold line 132 (step St60), as illustrated in FIG. 12H. When the additional folding processing is completed, the conveyance roller pair 102 and the folding roller pair 105 are rotated to convey the sheet S to the downstream side (step St61).

Figure 12I:
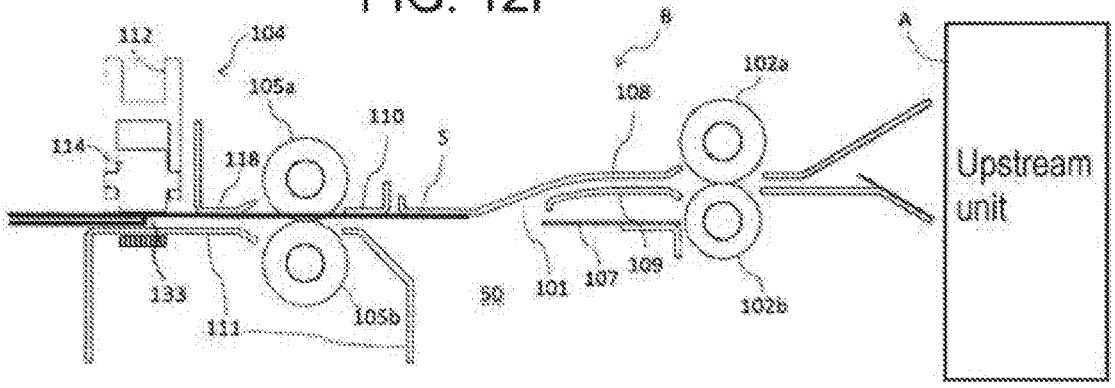

Similarly to step St82, when the conveyance of the sheet S to the downstream side is started, each activation of the conveyance roller pair 102 and the folding roller pair 105 may be started with a time difference. Specifically, for example, the folding roller pair 105 is activated first, and then the conveyance roller pair 102 is activated after a predetermined time has elapsed. Due to setting an appropriate time difference between the activation start of the conveyance roller pair 102 and that of the folding roller pair 105, the second loop FL2 formed in the loop forming space 50 can be eliminated or reduced. The second loop FL2 may be formed after the loop FL is drawn into the folding roller pair 105. Here, since the additional folding processing of the second fold line 133 illustrated in FIG. 12I is the same as the additional folding processing of FIG. 8I of the first embodiment, description thereof will be omitted.

In the additional folding mechanism of the present embodiment, the roller for performing additional folding is supported so as to be rotatable about a rotation axis extending in the sheet conveyance direction and moves along the fold line of the sheet S to perform additional folding processing. However, the present invention is not limited to such an additional folding mechanism. For example, a roller having a rotation axis in the same direction as that of the folding roller pair may be used as long as the roller is provided with a mechanism for separating and contacting the fold line so that the fold line can pass through the additional folding position. Further, the additional folding mechanism is not limited to a rotating body such as a roller, but may be a plate shaped member which performs additional folding processing as nipping a fold line.

In the image forming system of the present embodiment illustrated in FIG. 1, the conveyance roller pair 102 and the conveyance path 101 for receiving a sheet discharged from the image forming apparatus A and conveying the sheet to the folding roller pair 105 are provided in the sheet folding processing apparatus B. However, the present invention is not limited to such a sheet folding processing apparatus and an image forming system.

For example, in a sheet post processing apparatus directly connected to a sheet discharging port of an image forming apparatus, a configuration in which a sheet from the image forming apparatus is received and conveyed by using a sheet discharging roller of the image forming apparatus that discharges an image formed sheet from the sheet discharging port while a conveyance roller on an upstream side corresponding to the conveyance roller pair 102 of the present embodiment is omitted has been conventionally known and put into practical use. Here, the sheet discharging path from the sheet discharging roller to the sheet discharging port in the image forming apparatus may be regarded as a part of the conveyance path of the sheet post processing apparatus that receives and conveys the sheet from the image forming apparatus.

The technical scope of the present invention includes an image forming system having such a configuration. In this case, the sheet folding processing apparatus of the present invention includes in function a part of the configuration of the sheet folding processing apparatus B, which is the upstream unit. More specifically, in the above description of the present embodiment, the conveyance roller pair 102 of the sheet folding processing apparatus B may be regarded as being replaced with the sheet discharging roller 15 of the image forming apparatus A, and the conveyance path 101 may be understood to have a portion on the upstream side in the sheet conveyance direction configured of a portion from the sheet discharging port 16 of the image forming apparatus A to a position slightly beyond the sheet discharging roller 15 to the upstream side.

In the above, the present invention has been described with reference to the preferred embodiments. However, the present invention is not limited to the above-described embodiments, and it is obvious to say that various changes or modifications can be made within the technical scope of the present invention.

The invention claimed is:

1. A sheet folding processing apparatus, comprising:

a feeding roller which conveys a sheet in a conveyance direction;

a folding roller pair which is arranged downstream in the conveyance direction of the feeding roller, rotates while nipping a predetermined position of the sheet conveyed by the feeding roller, and forms a fold line at the predetermined position;

a pushing member which is capable of moving the sheet to a pushing position at which the predetermined position is nipped by the folding roller pair by pushing the sheet;

a pressing member which is arranged downstream in the conveyance direction of the folding roller pair and presses the fold line formed by the folding roller pair at an additional folding position where additional folding processing to further press the fold line is to be performed; and a controller which controls the feeding roller, the folding roller pair, the pushing member, and the pressing member, wherein the controller controls the folding roller pair and the pressing member to form the fold line by the folding roller pair, convey the sheet downstream in the conveyance direction until the fold line passes through the additional folding position by a predetermined conveyance amount, convey the sheet upstream in the conveyance direction by reversely rotating after once stopping, stop sheet conveyance at a position where the fold line returns to the additional folding position, and then perform the additional folding processing by pressing the fold line, and wherein the controller controls the feeding roller to stop at a time when the additional folding processing is to be performed after the folding roller pair is reversely rotated and the fold line is returned to and stopped at the additional folding position.

2. A sheet folding processing apparatus, comprising:

a feeding roller which conveys a sheet in a conveyance direction;

a folding roller pair which is arranged downstream in the conveyance direction of the feeding roller, rotates while nipping a predetermined position of the sheet conveyed by the feeding roller, and forms a fold line at the predetermined position;

a pushing member which is capable of moving the sheet to a pushing position at which the predetermined position is nipped by the folding roller pair by pushing the sheet;

a pressing member which is arranged downstream in the conveyance direction of the folding roller pair and presses the fold line formed by the folding roller pair at an additional folding position where additional folding processing to further press the fold line is to be performed; and a controller which controls the feeding roller, the folding roller pair, the pushing member, and the pressing member, wherein the controller controls the folding roller pair and the pressing member to form the fold line by the folding roller pair, convey the sheet downstream in the conveyance direction until the fold line passes through the additional folding position by a predetermined conveyance amount, convey the sheet upstream in the conveyance direction by reversely rotating after once stopping, stop sheet conveyance at a position where the fold line returns to the additional folding position, and then perform the additional folding processing by pressing the fold line, and wherein the controller controls the feeding roller to convey the sheet downstream in the conveyance direction at a time when the additional folding processing is to be performed after the feeding roller pair is reversely rotated and the fold line is returned to and stopped at the additional folding position.

3. The sheet folding processing apparatus according to claim 2, wherein the predetermined conveyance amount is set so that a rear end of the sheet in the conveyance direction is positioned in a conveyance path for conveyance of the sheet from a feeding roller side to a folding roller pair side along the conveyance direction by a time of completion of the additional folding processing of the fold line at the latest.

4. The sheet folding processing apparatus according to claim 2, further comprising:

a conveyance path for conveyance of the sheet from a feeding roller side to a folding roller pair side along the conveyance direction; and a space formed below the conveyance path to hang down the sheet from the conveyance path at the upstream side of the folding roller pair in the conveyance direction.

5. An image forming system comprising:

an image forming apparatus which forms an image on a sheet and discharges the image-formed sheet; and the sheet folding processing apparatus according to claim 2 which performs folding processing on the sheet discharged from the image forming apparatus.

6. A sheet folding processing apparatus, comprising:

a feeding roller which conveys a sheet in a conveyance direction;

a folding roller pair which is arranged downstream in the conveyance direction of the feeding roller, rotates while nipping a predetermined position of the sheet conveyed by the feeding roller, and forms a fold line at the predetermined position;

a pushing member which is capable of moving the sheet to a pushing position at which the predetermined position is nipped by the folding roller pair by pushing the sheet;

a pressing member which is arranged downstream in the conveyance direction of the folding roller pair and presses the fold line formed by the folding roller pair at an additional folding position where additional folding processing to further press the fold line is to be performed; and a controller which controls the feeding roller, the folding roller pair, the pushing member, and the pressing member, wherein the controller controls the folding roller pair and the pressing member to form the fold line by the folding roller pair, convey the sheet downstream in the conveyance direction until the fold line passes through the additional folding position by a predetermined conveyance amount, convey the sheet upstream in the conveyance direction by reversely rotating after once stopping, stop sheet conveyance at a position where the fold line returns to the additional folding position, and then perform the additional folding processing by pressing the fold line, and wherein, at a time when the additional folding processing is to be performed after the feeding roller pair is reversely rotated and the fold line is returned to and stopped at the additional folding position, the controller controls the feeding roller and the folding roller pair to convey the sheet upstream in the conveyance direction after the feeding roller is reversely rotated and to set a sheet conveyance amount with the reverse rotation of the feeding roller to be less than a sheet conveyance amount with the reverse rotation of the folding roller pair.

7. A sheet folding processing apparatus comprising:

a feeding roller which conveys a sheet in a conveyance direction;

a folding roller pair which is arranged downstream in the conveyance direction of the feeding roller, rotates while nipping a predetermined position of the sheet conveyed by the feeding roller, and forms a fold line at the predetermined position;

a pushing member which is capable of moving the sheet to a pushing position at which the predetermined position is nipped by the folding roller pair by pushing the sheet;

a first pressing member which is arranged downstream in the conveyance direction of the folding roller pair and presses the fold line;

a second pressing member which is arranged facing the first pressing member to nip the conveyed sheet and performs additional folding processing by pressing the fold line in cooperation with the first pressing member;

a moving mechanism which moves the first pressing member among an additional folding position in the conveyance direction at which additional folding processing is performed between the first pressing member and the second pressing member, a pressing position at which the first pressing member is brought close to the second pressing member and the fold line is pressed, and a retracting position at which the first pressing member is separated from the second pressing member in a direction being separated from the sheet, the moving mechanism further moving the first pressing member along the fold line with respect to the second pressing member in a state that the first pressing member is moved to the pressing position; and a controller which controls the feeding roller, the folding roller pair, the pushing member, the first pressing member, and the moving mechanism, wherein the controller controls the folding roller pair and the moving mechanism to form the fold line by the folding roller pair, convey the sheet downstream in the conveyance direction until the fold line passes through the additional folding position by a predetermined conveyance amount, convey the sheet upstream in the conveyance direction by reversely rotating after once stopping, stop sheet conveyance at a position where the fold line returns to the additional folding position, and then perform the additional folding processing by pressing the fold line between the first pressing member and the second pressing member.

8. The sheet folding processing apparatus according to claim 7, wherein the controller controls the feeding roller to stop at a time when the additional folding processing is to be performed after the folding roller pair is reversely rotated and the fold line is returned to and stopped at the additional folding position.

9. The sheet folding processing apparatus according to claim 7, wherein the controller controls the feeding roller to convey the sheet downstream in the conveyance direction at a time when the additional folding processing is to be performed after the feeding roller pair is reversely rotated and the fold line is returned to and stopped at the additional folding position.

10. The sheet folding processing apparatus according to claim 7, wherein, at a time when the additional folding processing is to be performed after the feeding roller pair is reversely rotated and the fold line is returned to and stopped at the additional folding position, the controller controls the feeding roller and the folding roller pair to convey the sheet upstream in the conveyance direction after the feeding roller is reversely rotated and to set a sheet conveyance amount with the reverse rotation of the feeding roller to be less than a sheet conveyance amount with the reverse rotation of the folding roller pair.

11. The sheet folding processing apparatus according to claim 7, wherein the predetermined conveyance amount is set so that a rear end of the sheet in the conveyance direction is positioned in a conveyance path for conveyance of the sheet from a feeding roller side to a folding roller pair side along the conveyance direction by a time of completion of the additional folding processing at the latest.

12. The sheet folding processing apparatus according to claim 7, further comprising:

a conveyance path for conveyance of the sheet from a feeding roller side to a folding roller pair side along the conveyance direction; and a space formed below the conveyance path to hang down the sheet from the conveyance path at the upstream side of the folding roller pair.

13. An image forming system comprising:

an image forming apparatus which forms an image on a sheet and discharges the image-formed sheet; and the sheet folding processing apparatus according to claim 7 which performs folding processing on the sheet discharged from the image forming apparatus.

* * * * *